US007832723B2

(12) United States Patent
Tsukamoto et al.

(10) Patent No.: US 7,832,723 B2
(45) Date of Patent: Nov. 16, 2010

(54) SHEET FEEDING APPARATUS HAVING A SEPARATING MEMBER AND SPEED DETECTING UNIT

(75) Inventors: Kazuyuki Tsukamoto, Kanagawa (JP); Shin Takeuchi, Kanagawa (JP); Katsumi Sakamaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 37 days.

(21) Appl. No.: 12/314,641

(22) Filed: Dec. 15, 2008

(65) Prior Publication Data

US 2009/0184457 A1 Jul. 23, 2009

Related U.S. Application Data

(62) Division of application No. 10/939,408, filed on Sep. 14, 2004, now Pat. No. 7,481,421.

(30) Foreign Application Priority Data

Feb. 24, 2004 (JP) ..... P2004-047791
Mar. 2, 2004 (JP) ..... P2004-057445

(51) Int. Cl.
*B65H 3/52* (2006.01)

(52) U.S. Cl. ..... 271/125; 271/122; 271/124

(58) Field of Classification Search ..... 271/109, 271/110, 124, 125, 258.01, 262, 263, 272, 271/122, 123
See application file for complete search history.

(56) References Cited

U.S. PATENT DOCUMENTS

| | | | |
|---|---|---|---|
| 5,172,900 | A | 12/1992 | Uno et al. |
| 5,273,269 | A | 12/1993 | Iwanaga |
| 5,882,002 | A | 3/1999 | Kamei et al. |
| 6,378,858 | B1 | 4/2002 | Suga |
| 6,672,579 | B2 | 1/2004 | Araki et al. |
| 7,036,815 | B2 | 5/2006 | Yamamoto |
| 7,052,008 | B2 | 5/2006 | Mitsuya et al. |
| 2002/0020959 | A1 | 2/2002 | Matsuda et al. |
| 2004/0188916 | A1 | 9/2004 | Tsukamoto et al. |

FOREIGN PATENT DOCUMENTS

| | | |
|---|---|---|
| JP | 59012029 A | 1/1984 |
| JP | 59053344 A | 3/1984 |
| JP | 2000-044076 | 2/2000 |
| JP | 2000-264489 | 9/2000 |
| JP | P 3048685 B | 3/2002 |

*Primary Examiner*—Richard W Ridley
*Assistant Examiner*—Jeremy Severson
(74) *Attorney, Agent, or Firm*—Morgan, Lewis & Bockius LLP

(57) ABSTRACT

There is provided a sheet feeding apparatus including a first feeding member that feeds at least one of the sheets from a discharge tray; a second feeding member that feeds the sheet fed by the first feeding member; a separating member, wherein a nip portion is formed between the separating member and the second feeding member, and when two sheets are entered the nip portion, the separating member separates one of the entered sheets from the other; an adjusting unit that changes a force of the separating member; a detecting unit that detects at least one of a distance by which the other of the entered sheets is transported beyond the nip portion and an advancing speed of the other of the entered sheets at the nip portion; and a controller that controls the adjusting unit based on a detection value of the detecting unit.

9 Claims, 11 Drawing Sheets

SHEET FEEDING APPARATUS HAVING A SEPARATING MEMBER AND SPEED DETECTING UNIT

This is a divisional application of application Ser. No. 10/939,408, filed on Sep. 14, 2004 now U.S. Pat. No. 7,481, 421, which is hereby incorporated by reference.

BACKGROUND OF THE INVENTION

1. Field of the Invention

The present invention relates to a sheet feeding apparatus for feeding record sheets such as a paper laminated on a discharge tray or a document tray to an image outputting portion or an image reading portion while separating the record sheets one-by-one in an image forming apparatus such as a copier, a facsimile, a printer or the like, in details relates to an improvement in a sheet feeding apparatus capable of arbitrarily adjusting a separating force exerted between a record sheet to be transported and a sheet fed doubly with the record sheet.

2. Description of the Related Art

Conventionally, there is known a system for feeding record sheets laminated on a discharge tray while separating the record sheets one-by-one including a combination of a feeding roller and a separating roller applied with a reverse rotational torque. According to the system, a pickup roller is brought into contact with a topmost record sheet of the record sheets laminated on the discharge tray, the record sheet is drawn from the discharge tray by rotating the pick up roller and thereafter, a front end of the record sheet is entered s a nip portion formed by the feeding roller and the separating roller. Whereas the feeding roller is rotated in the same rotational direction as that of the pick up roller, namely, in a direction of feeding the record sheet further forwardly, the separating roller is applied with a rotational torque in a direction reverse to the direction of feeding the record sheet through a torque limiter and is brought into press contact with the feeding roller.

When the separating roller is brought into direct contact with the feeding roller (when the record sheet is not present at the nip portion) and when only one sheet of the record sheets is present at the nip portion, a rotational torque exceeding a limit value of the torque limiter acts on the separating roller by the feeding roller and the separating roller is driven to rotate by the feeding roller. Thereby, when only one sheet of the record sheets is entered the nip portion between the feeding roller and the separating roller by rotating the pickup roller, the record sheet is fed by the feeding roller and the separating roller is driven thereby to rotate.

On the other hand, when two or more sheets of the record sheets are fed into the nip portion between the feeding roller and the separating roller, the limit value of the torque limiter overcomes a friction force between the overlapped record sheets. Consequently, the separating roller is rotated in the direction reverse to the direction of feeding the record sheet to push back the record sheet on a lower side, with which the separating roller is brought into direct contact, toward the discharge tray. Thereby, whereas the topmost record sheet brought into contact with the feeding roller is fed by rotating the feeding roller, the record sheet entered the nip portion along with the topmost record sheet is brought back toward the discharge tray by rotating the separating roller. As a result, double feeding of the record sheets is prevented.

According to such a separating sheet feeding system, when a feeding force in a reverse direction exerted to a second record sheet by the separating roller is larger than a feeding force for dragging the second record sheet by a first record sheet to be transported, that is, a friction force acting between the first record sheet and the second record sheet, separating operation is acted between the first record sheet and the second record sheet and only the first record sheet is fed. Therefore, in order to firmly prevent the second record sheet from being transported with the first record sheet, it is necessary to precisely control the feeding force in the reverse direction acting on the second record sheet by the separating roller.

Since the feeding force in the reverse direction differs by a force of bringing the separating roller into press contact with the feeding roller, or a friction coefficient of the separating roller, according to a sheet feeding apparatus disclosed in Japanese Patent No. 3048685, attention is paid to a point that when a separating roller is rotated in accordance with a recording sheet passing a nip portion, a rotational number of the separating roller is changed with time. In the sheet feeding apparatus, when the rotational number becomes equal to or smaller than a predetermined value, it is determined that a friction coefficient of the separating roller is reduced and the force of bringing the separating roller into press contact with the feeding roller is enhanced.

However, according to the sheet feeding apparatus, the press contact force of the separating roller is changed based on the rotational number of the separating roller when a record sheet to be transported is fed and therefore, the press contact force is optimized when a successive record sheet is fed and the optimum press contact force cannot act on the record sheet when at least the rotational number of the separating roller is being measured. That is, with regard to the record sheet at which the rotational number of the separating roller is being measured, it is difficult to optimize the press contact force of the separating roller and therefore, there is a possibility that double feeding of the record sheets is brought about.

Meanwhile, according to a paper sheet separator disclosed in JP-A-2000-264489, temperature and humidity of a surrounding atmosphere of a nip portion are detected, a number of paper sheets entered the nip portion is detected, and by changing a rotational number of a feeding roller, a rotational torque in a reverse direction of the separating roller and a force of bringing the separating roller into press contact with the feeding roller based on the results of detection, the paper sheets are separated at high speed and firmly. Further, according to an sheet media separation device disclosed in JP-A-2000-044076, a separating roller is controlled to rotate in a direction reverse to a direction of feeding sheet media only when a plurality of sheets are entered a nip portion.

However, even when a plurality of record sheets is overlapped and entered the nip portion between the feeding roller and the separating roller, double feeding of the record sheets is not necessarily brought about but there is also a case in which even when, for example, first and second record sheets are overlapped and entered the nip portion, advancement of the second record sheet is hampered by the separating roller and only the first record sheet is normally fed. Therefore, it is not necessarily needed to reduce the force of bringing the separating roller into press contact with the feeding roller or to enhance the rotational torque in the reverse direction applied to the separating roller by entering a plurality of record sheets into the nip portion. Further, when the rotational torque in the reverse direction applied to the separating roller is unreasonably enhanced, an extra load more than necessary is applied to feeding the record sheet by the feeding roller and poses a problem that not only wear of the feeding roller is accelerated but also paper powders are liable to be adhered to the feeding roller and feeding of the record sheets becomes unstabilized.

Further, the separating force acting between the first record sheet and the second record sheet is varied also by a kind or a thickness of the record sheet set to the discharge tray and therefore, the separating force cannot pertinently be adjusted only by detecting a number of record sheets entered the nip portion, thereby a problem that double feeding of the record sheets is brought about, or the load of the feeding roller is increased more than necessary is posed.

SUMMARY OF THE INVENTION

The invention has been carried in view of the problems and it is an object thereof to provide a sheet feeding apparatus that can firmly prevent double feeding of record sheets from a record sheet fed first even when a kind or a thickness of the record sheet to be transported is changed and in which extra load does not act on a feeding roller.

To achieve the above-described object, according to an aspect of the invention, there is provided a sheet feeding apparatus including: a discharge tray on which a plurality of record sheets are set; a first feeding member that feeds at least one of the record sheets from the discharge tray; a second feeding member that feeds the record sheet fed by the first feeding member; a separating member, wherein a nip portion is formed between the separating member and the second feeding member, and when two record sheets overlapping each other are entered the nip portion, the separating member separates one of the entered record sheets from the other; a separation adjusting unit that changes a force of the separating member acting on the other of the entered record sheets; a detecting unit that detects at least one of a distance by which the other of the entered record sheets is transported beyond the nip portion and an advancing speed of the other of the entered record sheets at the nip portion; and a separating force controller that controls the adjusting unit based on a detection value of the detecting unit.

Namely, according to a result of investigation by repeatedly carrying out experiments by the inventors, even when a second record sheet is entered the nip portion between the second feeding member and the separating member with a fist record sheet to be transported, as far as the second record sheet is locked by the separating member before advancing by a predetermined distance, the first record sheet and the second record sheet are normally separated, further, even when the second record sheet is advanced by the predetermined distance after being entered the nip portion, in a case where the advancing speed is slower than a predetermined speed, the first record sheet and the second record sheet are normally separated. Therefore, when an entering distance of a doubly-fed record sheet (second record sheet) into the nip portion is detected by a double feeding degree detecting unit, which detects the entering distance, it can be determined whether the doubly-fed second record sheet passes through the nip portion along with the first sheet. Further, it is found that when the advancing speed of the second record sheet is slow, the first record sheet and the second record sheet are normally separated, conversely, the faster the advancing speed of the second record sheet after entering the nip portion, the higher the danger of doubly feeding the second record sheet as it is along with the first record sheet. Therefore, when the advancing speed of the doubly-fed record sheet at the nip portion is detected by using a double feeding speed detecting unit, it can be determined whether the doubly-fed second record sheet passes through the nip portion along with the first record sheet. When the separating force controller is configured to control a separating force adjusting unit based on the detected entering distance or the detected advancing speed, double feeding of the record sheets can firmly be prevented without being influenced by a kind or a thickness of the record sheet to be transported and without being influenced by a change in a friction coefficient of the feeding roller or the separating roller.

Further, a possibility of bringing about double feeding of the record sheets is determined by the entering distance of the second record sheet into the nip portion or the advancing speed of the second record sheet at the nip portion and therefore, the force for bringing the separating member into press contact with the feeding roller, or a magnitude of a reverse rotational torque applied to the separating member is not unreasonably enhanced but a rotational load of the feeding roller can be reduced and wear of the feeding roller can be restrained.

In such technical means, the second feeding member may be a feeding roller in a shape of a roll provided with a predetermined friction coefficient at a surface thereof, or may be of a type of hanging an endless belt provided with the predetermined friction coefficient around a plurality of feeding rollers and bringing the belt into contact with a surface of a record sheet to be transported. Further, a separating member may be configured by a shape of a pad provided fixedly or may be configured by a shape of a roll driven to rotate by the second feeding member as far as the separating member forms the nip portion by being brought into press contact with the second feeding member. When the operating member is configured by a shape of a roll, that is, as a separating roller, as far as the separating roller is driven to rotate by the second feeding member or the record sheet only when a torque equal to or larger than a predetermined value is operated thereto, the separating roller may be of a type of being supported simply through a torque limiter, or may be of a type of being rotated in a direction reverse to a direction of feeding the record sheet positively by a motor.

Further, various configurations can be adopted for the separation adjusting unit as far as the separation adjusting unit can adjust the separating force for locking a doubly-fed record sheet (second record sheet) entered the nip portion by being dragged by the record sheet to be transported (the first record sheet brought into contact with the second feeding member) by the separating member. For example, the separation adjusting unit may change the force of bringing the separating member into press contact with the second feeding member or the separation adjusting member may change the magnitude of the rotational torque in the reverse direction applied to the separating member.

Various configurations can be adopted for the double feeding degree detecting unit as far as the double feeding degree detecting unit can detect an entering distance of a front end of the doubly-fed record sheet to pass the nip portion, that is, an entering distance of the doubly-fed record sheet into the nip portion. For example, the double feeding degree detecting unit may be configured such that a detecting arm pivoted by being pushed back by the front end of the record sheet passing the nip portion is provided and the entering distance of the doubly-fed record sheet is detected in accordance with a pivoting angle of the detecting arm, or may be configured such that a pair of electrodes are arranged by interposing a path of feeding the record sheet on a downstream side of the nip portion and the entering distance of the doubly-fed record sheet is detected from a change in an electrostatic capacitance between the electrodes.

Meanwhile, even when the first record sheet and the second record sheet are entered the nip portion in an overlapped state, it is normal that the second record sheet is slipped from the first record sheet and therefore, by detecting a rotational angle of the separating member, that is, a rotational angle of the separating member driven to rotate by the second record sheet, an entering distance of the front end of the second record sheet to pass the nip portion can be grasped. However, even when the rotational angle of the separating member is checked, a complete double feeding state in which slippage is not brought about at all between the first record sheet and the second record sheet and a state in which only the first record sheet is entered the nip portion cannot be discriminated from each other and therefore, unit for detecting a number of record sheets entered the nip portion needs to provide separately. Or, an inclining angle of the discharge tray or a force for bringing the first feeding member into press contact with the first record sheet needs to adjust such that a plurality of record sheets are always entered the nip portion.

Further, a timing of instructing to enhance a separating force to the separation adjusting unit by the separation force controller may instruct to enhance the separating force by determining that there is a high possibility that the second record sheet passes through the nip portion as it is when the entering distance of the second record sheet into the nip portion exceeds a predetermined value, that is, when a detected distance of the double feeding degree detecting unit exceeds a predetermined value. However, in most of cases, even when a front end of the second record sheet is advanced from the nip portion by a predetermined distance, in the case in which the advancing speed is small, advancement of the second record sheet is locked by the separating member and from such a standpoint, the detected distance of the double feeding degree detecting unit may be checked at a predetermined timing after entering the front end of the record sheet into the nip portion and the separating force controller may be configured to instruct to enhance the separating force only when the detected valued exceeds a predetermined value.

Various configurations can be adopted for the double feeding speed detecting unit as far as the advancing speed of the doubly-fed record sheet of which the front end is entered the nip portion can be detected. For example, the advancing speed of the doubly-fed record sheet can be configured to grasp by pressing a roller to a rear face of the doubly-fed record sheet passing the nip portion and detecting a rotational speed of the roller by an encoder. Further, when the separating member is configured as a separating roller as described above, the advancing speed of the doubly-fed record sheet can also be grasped from the rotational speed of the separating roller.

However, when the advancing speed of the record sheet is detected from the rotational speed of the roller brought into contact with the rear face of the record sheet in this way, it is necessary to determine whether only one sheet of the record sheet is entered the nip portion, or a plurality of sheets thereof are entered thereto. Because when a number of record sheets is not assumedly determined, it cannot be determined whether the advancing speed of the record sheet detected by the double feeding speed detecting unit is for the first record sheet or for the second record sheet. Further, when the sheet number detecting sensor for detecting the number of record sheets entered to the nip portion is not provided, in feeding the record sheet to the nip portion by the first feeding member, it is necessary to adjust the inclining angle of the discharge tray or the force of bringing the first feeding member into press contact with the first record sheet such that a plurality of record sheets are always entered the nip portion.

Further, a timing of instructing to enhance the separating force to the separation adjusting unit by the separation force controller may instruct to enhance the separating force by determining that there is a high possibility of passing the second record sheet to the nip portion as it is when the advancing speed of the second record sheet at the nip portion exceeds a predetermined value, that is, when the detected value of the double feeding speed detecting unit exceeds a predetermined value. Or, the detected value of the double feeding speed detecting unit may be checked at a predetermined timing after the front end of the record sheet is entered the nip portion and the separating force controller may be configured to instruct to enhance the separating force only when the detected value exceeds a predetermined value.

According to the invention configured as described above, even when a kind or a thickness of the record sheet to be transported is changed, double feeding of the record sheets can firmly be prevented from the record sheet fed first by immediately detecting whether the separating force operated to the record sheet is sufficient with regard to the record sheet being fed and correcting the separating force immediately when the separating force is deficient. Further, a control parameter with regard to the separating force needs not to set excessively and operation of feeding the record sheet can be stabilized by alleviating the load operated to the second feeding member and restraining occurrence of wear and paper powders of the second feeding member.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

A detailed explanation will be given of a sheet feeding apparatus of the invention in reference to the attached drawings as follows.

Figure 1:
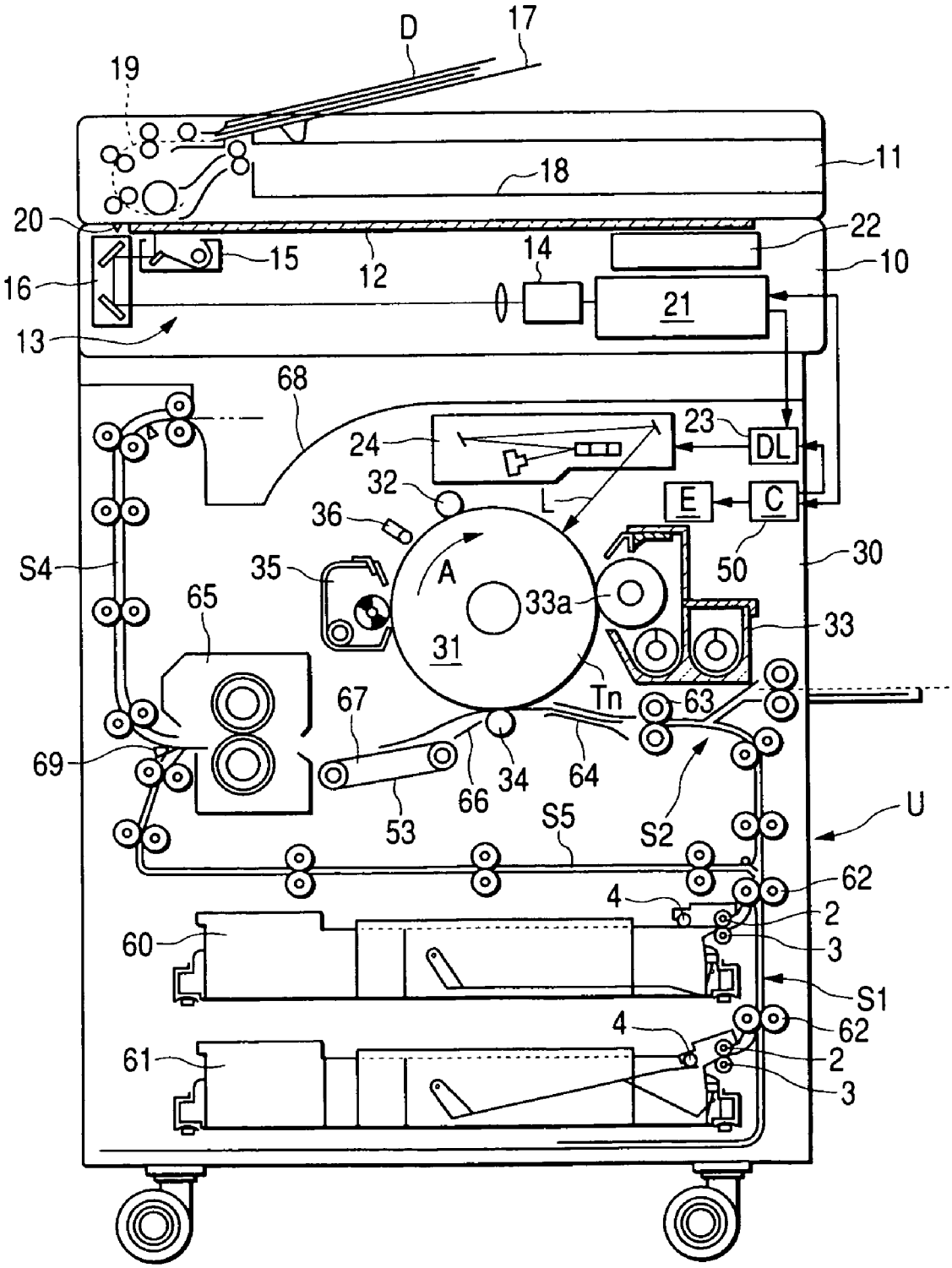
FIG. 1 is an outline block diagram showing an example of a digital copier having a sheet feeding apparatus according to the invention.

FIG. 1 is a vertical sectional view of a digital copier in which a sheet feeding apparatus of the invention is applied to a sheet feeding mechanism. The copier U is configured by an image reading portion (IIT) 10 for optically reading a document image to convert into an image data as an electric signal, and an image outputting portion (IOT) 30 for forming a record image on a record sheet based on the image data, further, the image reading portion 10 is mounted with an automatic document feeding apparatus 11 for continuously reading a plurality of sheets.

The image reading portion 10 is provided with a platen glass 12 as a document base and the automatic document feeding apparatus 11 functions as a platen cover for covering the platen glass 12. The image reading portion 10 is provided with an exposure optical system 13 below the platen glass 12, provided with a CCD sensor 14 which is a solid image taking element and is configured to focus reflected light of a document D set on the platen glass 12 onto an image taking face of the CCD sensor 14 through the exposure optical system 13. The exposure optical system 13 configures a contraction optical system by providing a platen carriage 15 for exposing to scan the document image while moving along a lower face of the platen glass 12, and a mirror carriage 16 for guiding the reflected light of the document image to the CCD sensor 14.

The automatic document feeding apparatus 11 includes a document discharge tray 17 overlappingly mounted with a plurality of sheets of the document D and includes a document discharge tray 18 for discharging the document finished with reading and the document D is configured to pass a feeding position on the platen glass 12 at a middle of a document feeding path 19 reaching the document discharge tray 18 from the document discharge tray 17.

The exposure optical system 13 includes a registering sensor 20 for detecting positions of the lamp carriage 15 and the mirror carriage 16 and the respective carriages 15, 16 are made to be able to set to home positions shown in FIG. 1 by a detecting signal of the registering sensor 20. In the case of a ADF mode for reading the document image by using the automatic document feeding apparatus 11, the lamp carriage 15 and the mirror carriage 16 are set to the home positions and the document image is scanned while feeding the document D from the document discharge tray 17 to the document discharge tray 18. Meanwhile, in the case of a platen mode for carrying out copying operation by placing the document D on the platen glass 12 sheet by sheet by a user without using the automatic document feeding apparatus 11, a document image is scanned while moving the lamp carriage 15 and the mirror carriage 16 below the platen glass 12. The reflected light provided from the document image is made to be incident on the CCD sensor 14 and converted into a reading image signal as an electric signal by the CCD sensor 14.

Meanwhile, the copier U includes an image processing portion 21 provided at the image reading portion 10 or the image outputting portion 30 and a user interface 22 for inputting information or the like with regard to copying operation by the user or displaying information or the like with regard to a condition of the copier U.

The image processing portion 21 converts the reading image signal inputted from the CCD sensor 14 into a digital image writing signal to output to a laser driving signal outputting apparatus 23 of the image outputting portion 30. The laser driving signal outputting apparatus 23 outputs a laser driving signal in accordance with the inputted image writing signal to a raster scanning apparatus (ROS) 24. Operation of the image processing portion 21, the laser driving signal outputting apparatus 23, a power source circuit E and the like is controlled by a controller 50 configured by a computer.

A photosensitive drum 31 arranged below the raster scanning apparatus 24 is rotated in an arrow mark A direction. A surface of the photosensitive drum 31 is entered, for example, −700 V by a charge roller 32 and thereafter exposed to scan by laser beam L emitted from the raster scanning apparatus 24. Thereby, the surface of the photosensitive drum 31 is formed with an electrostatic latent image at, for example, −300 V in accordance with the image writing signal.

Next, the surface of the photosensitive drum 31 to which the electrostatic latent image is written passes a position opposed to a processing apparatus 33. The processing apparatus 33 includes a two components developer configured by a toner and a carrier, the developer is magnetically adsorbed by a developing roller 33*a* to feed to a position opposed to the photosensitive drum 31, and the electrostatic latent image formed on the surface of the photosensitive drum 31 is developed by the toner entered in minus polarity. Thereby, the surface of the photosensitive drum sensor 31 is formed with a toner image Tn visualizing the electrostatic latent image.

In this way, the surface of the photosensitive drum 31 formed with the toner image Tn is made to advance successively to a transcribing position of the toner image Tn facing a path of feeding the record sheet P. A transcribing roller 34 is arranged at the transcribing position to be brought into contact with the photosensitive drum 31. The transcribing roller 34 is supplied with a transcribing voltage having a polarity reverse to the polarity of charging the toner from the power source circuit E, and the toner image Tn is transcribed onto the record sheet P by a transcribing electric field formed between the photosensitive drum 31 and the transcribing roller 34. Voltages of a charge bias applied to the charge roller 32, a developing bias applied to the developing roller 33*a*, a transcribing bias applied to the transcribing roller 34 and the like are supplied by the power source circuit E.

A lower portion of the image outputting portion 30 is arranged with a first sheet feeding tray 60 and a second sheet feeding tray 61 to align in an up and down direction. Pickup rollers 4 as feeding portions are arranged above right end portions of the first sheet feeding tray 60 and the second sheet feeding tray 61 and the record sheet P fed from each of the sheet feeding trays 60, 61 by the pickup roller 4 is transported to a first sheet feeding path S1 through a sheet feeding mechanism 1 provided on a right side of the sheet feeding tray 60, 61.

Each of the sheet feeding mechanism 1 includes a feeding roller 2 as a rotational sheet feeding member, a separating roller 3 as a rotational separating member forming a nip portion by being brought into press contact with the feeding roller 2, and the pickup roller 4. The record sheets P fed to the nip portion N are separated sheet by sheet by operating the sheet feeding mechanism 1 and are fed to the first sheet feeding path S1. The first sheet feeding path S1 is extended in an up and down direction along a right side face of the image outputting portion 30 and the first sheet feeding path S1 is arranged with a feeding roller 62. The sheet S fed to the first sheet feeding path S1 is fed to a second sheet feeding path S2 immediately before the position of transcribing the toner image Tn by the feeding roller 62.

The second sheet feeding path S2 is arranged with a registration roller (hereinafter, refers as "regiroller") 63, the record sheet P fed from the first sheet feeding path S1 is butted to the stationary regiroller 63 to be locked thereby temporarily to thereby improve skew of the record sheet P brought about in the midst of feeding. The regiroller 63 starts rotating at a predetermined timing in synchronism with a timing of moving the toner image Tn to the transcribing position and the record sheet P is fed to the transcribing position through a pre-transcription sheet guide 64. Thereby, the toner image can be transcribed to a predetermined position on the record sheet P.

After transcribing the toner image Tn onto the record sheet P, the surface of the photosensitive drum 31 is cleaned by a drum cleaner 35 and toner remaining after transcription is removed from the surface of the photosensitive drum 31. Further, the surface of the photosensitive drum 31 after having been cleaned is exposed uniformly by an electricity removing lamp 36 to erase a potential history and thereafter recharged by the charging roller 32 and is formed with the successive toner image Tn after having been processed by the same process.

The record sheet P transcribed with the toner image Tn is fed to a fixer 65 through a third feeding path S3. The third feeding path S3 is provided with a sheet guide 66 for removing electricity of the record sheet P entered by transcribing the toner image to promote to exfoliate from the photosensitive drum 31, and a sheet feeding belt 67 for delivering the record sheet P transcribed with the toner image to the fixer 65.

The toner image Tn of the record sheet P fed to the fixer 65 is heated to fix during a period of passing the fixer 65. The record sheet P having passed the fixer 65 is made to pass a sheet discharging path S4 and thereafter discharged to a discharge tray 68 arranged at an upper portion of the image outputting portion 30. A switch gate 69 is arranged at a portion of connecting the fixer 65 and the sheet discharging path S4 and the switch gate 69 selectively guides the record sheet P having passed the fixer 65 to either one of the sheet discharging path S4 or a both faces connection path S5.

The both faces connection path S5 connects the fixer 65 and the first sheet feeding path S1 and is configured such that the record sheet P fixed with the toner image Tn by the fixer 65 is fed to the first sheet feeding path S1. In the case of both faces copying forming record images on both faces of the record sheet P, the record sheet P recorded with the toner image of a first face is guided to the both faces connection path S5 by the switching gate 69 and fed to the first sheet feeding path S1 from a front end thereof by rotating the feeding roller 62 provided at the sheet feeding path S1 reversely. Further, at a time point at which a rear end of the record sheet P is brought into the first sheet feeding path S1, the feeding roller 62 is rotated reversely to feed the record sheet P to the second sheet feeding path S2. That is, according to the copier of the embodiment, the first sheet feeding path S1 serves also as an inverter path for inverting the record sheet P. The record sheet P one face of which has been recorded and which is fed again to the second sheet film path S2 is fed again to the position of transcribing the toner image Tn and the toner image Tn is transcribed also onto a second face similar to the first face.

Figure 2:
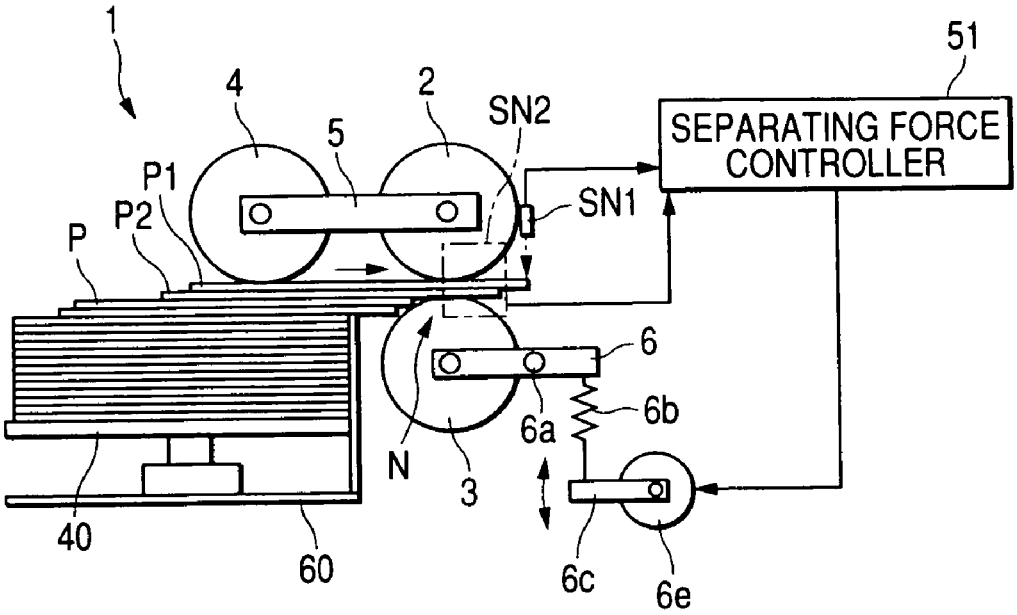
FIG. 2 is an outline block diagram of a sheet feeding mechanism to which a first embodiment of the invention is applied.
Figure 3:
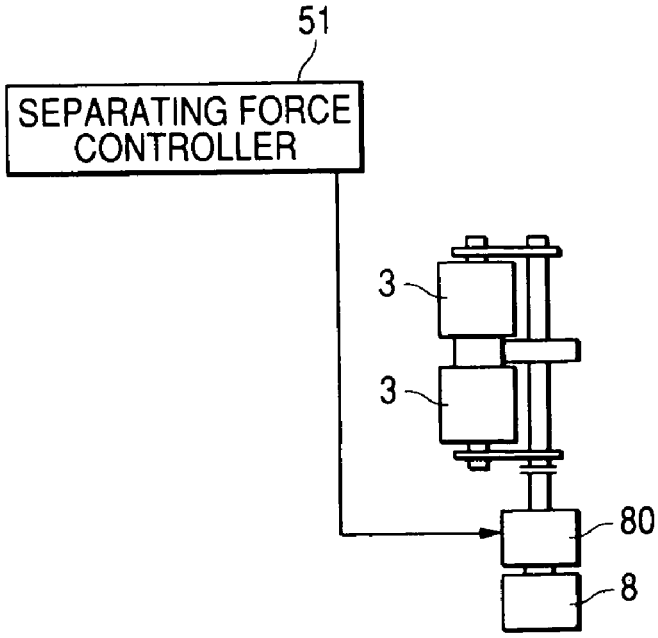
FIG. 3 is a plan view showing a system of driving a separating roller according to the first embodiment of the invention.

FIG. 2 and FIG. 3 are explanative views of the sheet feeding mechanism 1. As described above, the sheet feeding mechanism 1 includes the feeding roller 2, the separating roller 3 and the pickup roller 4, and by bringing the separating roller 3 into press contact with the feeding roller 2, the nip portion N is formed between the two rollers. The feeding roller 2 and the pickup roller 4 are driven by the same sheet feeding motor (not illustrated) to rotate in a direction of feeding the record sheet P in the discharge tray 60 or 61 to the first sheet feeding path S1.

Meanwhile, the separating roller 3 is rotated in a direction of returning the record sheet P to the discharge tray 60 or 61 by a separating motor 8. The sheet feeding motor applies a predetermined rotational torque to the feeding roller 2, the separating motor 8 is connected to the separating roller 3 through an electromagnetic clutch 80, and the rotational torque applied to the separating roller 3 can freely be changed by controlling an upper limit value of a transmitting torque of the electromagnetic clutch 80 in accordance with a situation of feeding the record sheet P at the nip portion N.

A rotating shaft of the feeding roller 2 and a rotating shaft of the pickup roller 4 are connected by a link lever 5 and the link lever 5 is configured to pivot centering on the rotating shaft. The link lever 5 is urged downwardly by a tension spring (not illustrated), and the pick up roller 4 is made to be brought into press contact with the record sheet P set to the discharge tray 60 or 61 from above. Further, a bottom plate 40 for moving up the record sheet to the pickup roller 4 is provided at inside of the discharge tray 60, 61, and the bottom plate 40 is configured to stop moving up when a topmost record sheet at inside of the discharge tray 60, 61 is brought into contact with the pickup roller 4 and the link lever 5 is lifted to a predetermined height. Thereby, the record sheet P disposed at the topmost position at inside of the discharge tray 60, 61 is brought into press contact with the pickup roller 4 always substantially at the same height.

When the sheet feeding motor is rotated, the pickup roller 4 is rotated, and the topmost record sheet P at inside of the discharge tray 60, 61 is fed to the nip portion N of the feeding roller 2 and the separating roller 3. The pickup roller 4 is coupled to the sheet feeding motor through an electromagnetic clutch (not illustrated) and includes a one way clutch and is separated from the sheet feeding motor by the electromagnetic clutch after a front end of the record sheet P is inserted into the nip portion N. Thereby, the record sheet P is fed by rotating the sheet feeding roller 2, the pickup roller 4 is driven by feeding the record sheet P and is brought into contact with a successive one of the record sheet to stop at a time point at which a rear end of the record sheet P has finished to pass therethrough.

When the pickup roller 4 is brought into press contact with the record sheet P at inside of the discharge tray 60, 61 excessively strongly, in rotating the pickup roller 4, not only the topmost record sheet P with which the pickup roller 4 is brought into contact but also a second sheet of the record sheet is fed from the discharge tray 60, 61 by being dragged by the topmost record sheet. In order to prevent double feeding of the record sheets P, it is necessary to optimally adjust a force for bringing the pickup roller 4 into press contact with the record sheet P in accordance with a kind or the like of the record sheet P set to inside of the discharge tray 60, 61. Therefore, a mechanism for adjusting an urging force of the connection spring 5*a* is provided although not illustrated, the urging force is made to be able to adjust in accordance with a frequency of occurrence of double feeding.

Meanwhile, a rotating shaft of the separating roller 3 is supported by a pivoting arm 6 pivotable around a supporting shaft 6*a*. The separating roller 3 is supported by one end of the pivoting arm 6 and other end thereof is connected with a tension spring 6*b* for urging the pivoting arm 6 downwardly. Thereby, the separating roller 3 is urged upwardly and is brought into press contact with the feeding roller 2. Further, a lower end of the tension spring 6*b* is connected to an arm 6*c* fixed to an output shaft of a nip pressure adjusting motor 6*e*. Therefore, by controlling an amount of rotating the nip pressure adjusting motor 6*e*, an urging force of the tension spring 6*b* can be changed, and a force of bringing the separating roller 3 into press contact with the feeding roller 2, that is, the nip pressure at the nip portion N is made to be able to adjust freely.

A sheet sensor SN 1 is arranged on a downstream side of the nip portion N, and the front end of the record sheet P inserted to between the feeding roller 2 and the separating roller 3 is made to be able to detect. That is, when a detecting signal of the sheet sensor SN 1 is checked, it can be determined whether the front end of the record sheet P advances in the nip portion N by a predetermined amount.

First Embodiment

A first embodiment of the invention will be explained as follows.

Figure 4:
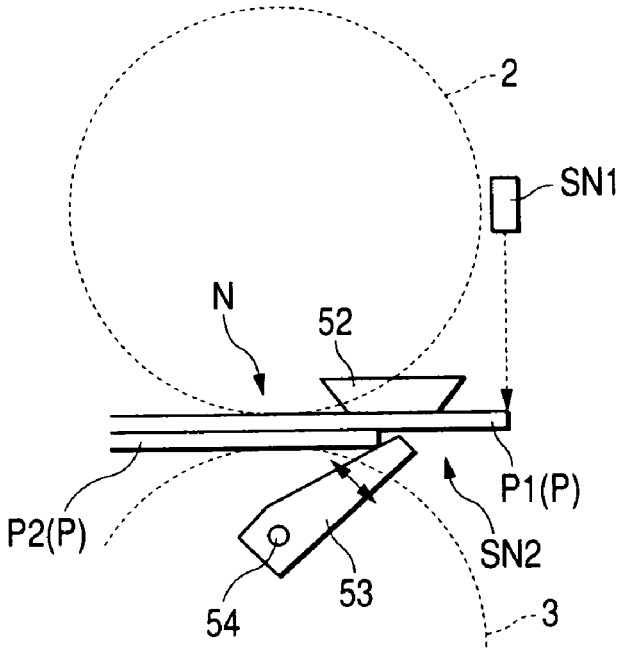
FIG. 4 is an enlarged view of a relevant portion showing a first embodiment of a double feeding degree detecting sensor.

According to the first embodiment, there is arranged a double feeding degree detecting sensor SN 2 for detecting whether a second record sheet P2 is doubly fed to the nip portion N by being overlapped with a first record sheet P1 to be transported between the nip portion N and a detecting position of the sheet sensor SN 1. As shown in FIG. 4, the double feeding degree detecting sensor SN 2 is configured by a base member 52 brought into contact with a surface of the first record sheet P1 on a downstream side of the feeding roller 2 in a direction of feeding the record sheet P, a pivotable detecting arm 53 a front end of which is urged to the base member 52, and an encoder (not illustrated) for detecting a pivoting angle of the detecting arm. The detecting arm 53 is pivotably supported by a supporting shaft 54, and in a state in which the record sheet P does not pass the nip portion N, the front end of the detecting arm 53 is brought into contact with the base member 52. Meanwhile, when the record sheet P advances to pass the nip portion N, the front end of the detecting arm 53 is pushed back by the record sheet P, the detecting arm 53 is pivoted in accordance with a number of record sheets P entered the nip portion N and an entering distance of the record sheet P from the nip portion N, and the pivoting angle is detected by the encoder.

Figure 5:
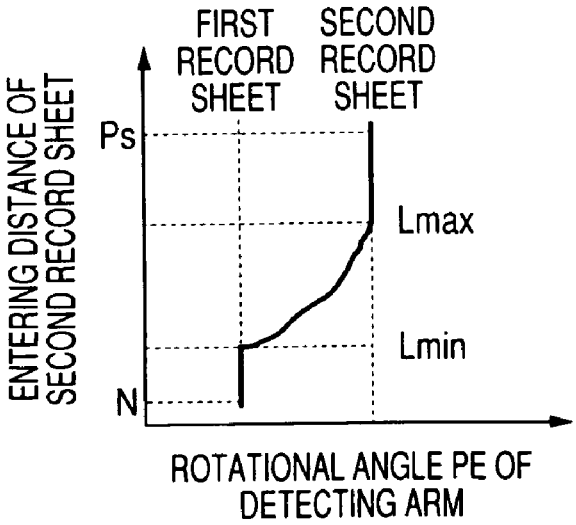
FIG. 5 is a graph showing an example of an output signal of the double feeding degree detecting sensor shown in FIG. 4.

Therefore, when an output signal of the encoder of the double feeding degree detecting sensor SN 2 is checked, it can be grasped whether a plurality of record sheets P are entered the nip portion N and to what degree the second record sheet P which is doubly fed advances from the nip portion N. FIG. 5 is a graph showing a relationship between an output signal of the double feeding degree detecting sensor SN 2 and an entering distance of the second record sheet P2 into the nip portion N when two sheets of the record sheets P1, P2 are entered the nip portion N overlappingly. The abscissa designates a rotational angle of the detecting angle of the detecting arm 53, that is, the output signal of the double feeding degree detecting sensor SN 2, and the ordinate designates an entering distance of the second record sheet P2 entered the nip portion N by being dragged by the first record sheet P1. When a front end of the second sheet P2 is made to pass the nip portion N retardedly from the first sheet P1, at a timing at which the front end of the second record sheet P2 is entered the nip portion N, the detecting arm 53 is brought into contact with a rear face of the first record sheet P1, and the rotational angle of the detecting arm 53 corresponds to a thickness of the first record sheet P1. Thereafter, when the second record sheet P2 advances from the nip portion N by a distance $L_{min}$, the front end of the second record sheet P2 is brought into contact with the detecting arm 53, the detecting arm 53 is pushed back by the front end of the second record sheet P2 and therefore, the rotational angle of the detecting arm 53 is gradually changed. The change of the rotational angel continues until the front end of the detecting arm 53 is completely mounted on a rear face of the second record sheet P2, that is, until the second record sheet P2 advances from the nip portion N by a distance $L_{max}$. Thereby, the double feeding degree detecting sensor SN 2 can measure the entering distance of the second record sheet P2 into the nip portion N between $L_{min}$ and $L_{max}$.

Both signals of the sheet sensor SN 1 and the double feeding degree detecting sensor SN 2 are inputted to a separating force controller 51. The separating force controller 51 is configured as a portion of the controller 50 and is provided with an input/output interface, not illustrated, for controlling to input and output signals to and from outside and levels of the input and output signals and soon, ROM (Read Only Memory) stored with programs, data and the like for executing necessary processing, RAM (Random Access Memory) for temporarily storing necessary data, CPU (Control Processing Unit) for executing processing in accordance with the programs stored to ROM, a clock oscillator and the like to realize various functions by executing the programs stored to ROM. Further, the separating force controller 51 is connected with the sheet feeding motor, the separating motor 8, the electromagnetic clutch 80 for coupling the separating motor 8 and the separating roller 3, and the nip pressure adjusting motor 6*e* and outputs control signals to the apparatus.

Next, an explanation will be given of a first control example of operation of feeding the record sheet in the sheet feeding mechanism.

Figure 6:
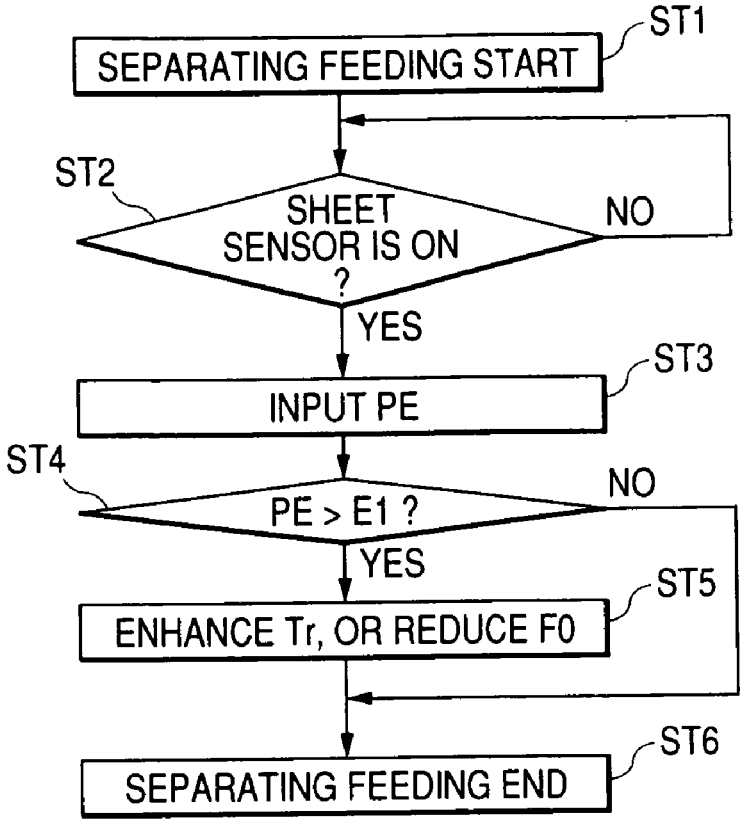
FIG. 6 is a flowchart showing a first control example of the sheet feeding mechanism according to the first embodiment of the invention.

FIG. 6 is a flowchart showing a processing procedure of the first example of the sheet feeding operation. First, the controller C checks whether a copy button provided at inside of an operation panel of the user interface 22 is pressed, that is, whether copy job is instructed to start by checking an output signal of the user interface 22. When it is determined that the copy job is instructed to start, the controller C checks whether a timing of feeding the record sheet P has arrived and when the sheet feeding timing is determined, the controller C instructs to start to drive the sheet feeding motor and the separating motor 8. Thereby, the sheet feeding motor 7 and the separating motor 8 start rotating.

When the sheet feeding motor starts driving, the feeding roller 2 and the pickup roller 4 start rotating, among the record sheets P set to the discharge tray 60 or 61, the topmost record sheet P1 is fed from the discharge tray 60 or 61 by the pickup roller 4 and is fed to the nip portion N at which the feeding roller 2 and the separating roller 3 are brought into press contact with each other. Operation up to the point corresponds to "separation feeding start" at ST 1 of FIG. 6.

Further, it is preferable to set the force of bringing the pickup roller 4 into press contact with the record sheet P1 to a degree of always drawing a plurality of record sheets P from the discharge tray 60 to the nip portion N by rotating the pickup roller 4. Because when the front end of the second record sheet P2 is drawn to immediately before the nip portion N in passing the first record sheet P1 through the nip portion N, a delay in feeding the second record sheet P2 can be reduced, further, the reduction is effective also for reducing a failure in feeding.

Next, the controller C checks the output signal of the sheet sensor SN 1 to thereby check whether the front end of the record sheet P1 fed from the discharge tray 60 or 61 is inserted into the nip portion N of the feeding roller 2 and the separating roller 3 (ST 2). Since the sheet sensor SN 1 is provided on the downstream side of the nip portion N in the direction of feeding the record sheet P1, such change in the output signal of the sheet sensor SN 1 signifies that the front end of the record sheet P1 is entered the nip portion N and passes through the double feeding degree detecting sensor SN 2 as shown in FIG. 3. When the controller C determines that the front end portion of the record sheet P1 passes the nip portion N from a change in the detecting signal of the sheet sensor SN 1, the controller C transmits a control signal to the electromagnetic clutch to separate the pickup roller 4 from the sheet feeding motor. Thereafter, the pickup roller 4 is driven to rotate by feeding the first record sheet P1. For convenience of the explanation, a timing at which the output signal of the sheet sensor SN 1 is changed is designated by notation t1.

Further, at the time t1, the separating force controller 51 configuring a portion of the controller C inputs the output signal PE of the double feeding degree detecting sensor SN 2 (ST 3) and checks whether the output signal PE exceeds a predetermined value E1 (ST 4). Here, the predetermined value E1 is set in a range of the rotational angle of the detecting arm 53 in correspondence with the distance of $L_{min}$ to $L_{max}$ of entering the second record sheet P2 into the nip portion N, mentioned above.

Further, when it is determined that the output signal PE of the double feeding degree detecting sensor SN 2 does not exceed the predetermined value E1, the entering distance of the second record sheet P2 into the nip portion N is small, there is not a possibility of doubly feeding the second record sheet P2 as it is along with the record sheet P1 and therefore, the feeding roller 2 is rotated as it is to continue feeding the record sheet P1.

Figure 7:
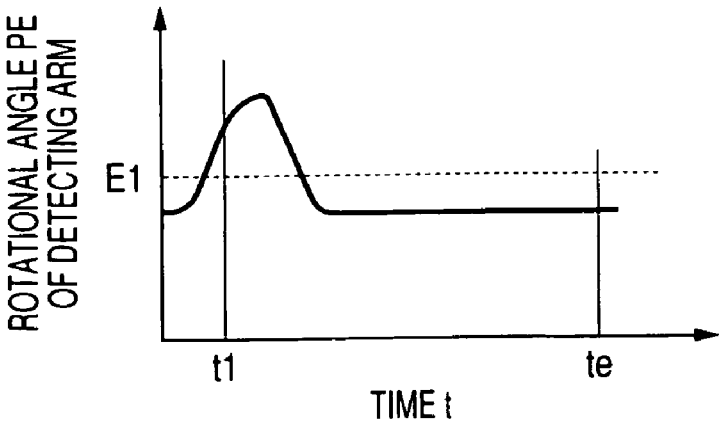
FIG. 7 is a graph showing an elapse of time of the output signal of the double feeding degree detecting sensor according to the first control example.

Meanwhile, in the case in which it is determined that the output signal PE of the double feeding degree detecting sensor SN 2 exceeds the predetermined value E1 at the time t1 as shown in FIG. 7, when the first record sheet P1 is continued to feed as it is, there is a high possibility of bringing about double feeding by feeding also the second record sheet P2 to the first sheet feeding path SH 1 along therewith. Therefore, the separating force controller 51 controls an upper limit transmitting torque of the electromagnetic clutch 80 to enhance a rotational torque Tr in a reverse direction transmitted from the separating motor 8 to the separating roller 3. Or, the separating force controller 51 reduces a force F0 of bringing the separating roller 3 into press contact with the rear face of the second record sheet P2 by slightly rotating the nip pressure adjusting motor 6*e* (ST 5). When the rotational torque Tr in the reverse direction transmitted from the separating motor 8 to the separating roller 3 is enhanced, a force of pushing back the second record sheet P2 in the direction of the discharge tray 60 is enhanced and a separating force operated between the first record sheet P1 and the second record sheet P2 can be enhanced. Further, when the press contact force F0 of the separating roller 3 is reduced, a friction force operated between the first record sheet P1 and the second record sheet P2 is reduced and therefore, the separating force operated between the first record sheet P1 and the second record sheet P2 can similarly be enhanced.

At ST 5 of FIG. 6, the separating force controller may enhance the rotational torque Tr in the reverse direction of the separating roller 3 or may reduce the press contact force F0 of the separating roller 3, or may enhance the rotational torque Tr and reduce the press contact force F0.

Thereby, it can effectively be prevented that the second record sheet P2 is doubly transported to the first sheet feeding path by being dragged by the first record sheet P1. Above all, a control parameter for separating the first record sheet and the second record sheet can instantly be changed by determining the possibility of bringing about double feeding of the record sheets with regard to sheet feeding operation which is being carried out and therefore, occurrence of double feeding can firmly be prevented. Further, by detecting the entering distance of the second record sheet P2 into the nip portion N, the possibility of bringing about double feeding is determined simultaneously with carrying out the sheet feeding operation and therefore, the control parameter of separating force is not unreasonably changed although the possibility of bringing about double feeding is low and a load on the feeding roller 2 can be reduced and sheet feeding operation can be stabilized.

When the first record sheet is fed to the first sheet feeding path SH 1 while preventing double feeding in this way, the controller C determines whether the rear end of the first record sheet P1 is drawn out from the nip portion N and instructs to stop the feeding motor 7 and the separating motor 8 when the rear end is determined to draw out therefrom. Thereby, separation feeding of the record sheet in the sheet feeding mechanism is finished (ST 6). Thereafter, the controller C checks whether the copy job has been finished and repeats to feed a successive one of the record sheet P when it is determined that the copy job has not been finished.

Figure 8:
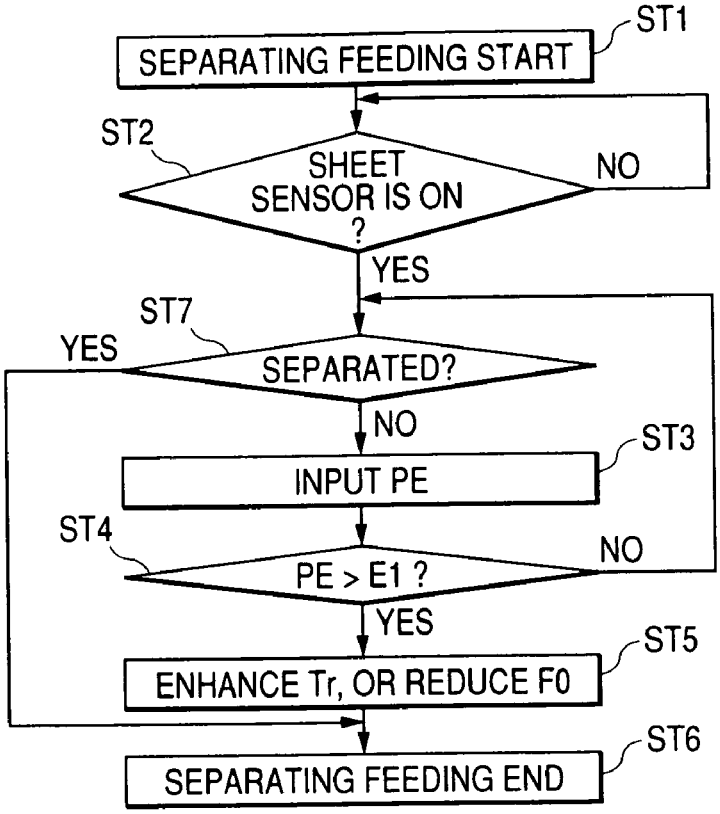
FIG. 8 is a flowchart showing a second control example of the sheet feeding mechanism according to the first embodiment of the invention.

FIG. 8 is a flowchart showing a processing procedure of a second control example of sheet feeding operation.

According to the above-described first control example, the output signal of the double feeding degree detecting sensor SN 2 is checked only at the time at which the front end of the first record sheet P1 entered the nip portion N is detected by the sheet sensor SN 1, that is, only at time t1, and when the entering distance of the second record sheet P2 into the nip portion N is equal to or smaller than the predetermined value E1 at the timing, the rotational torque Tr in the reverse direction of the separating roller 3 is not changed and the press contact force F0 of the separating roller 3 is not also changed. However, there is also a case in which the entering distance of the second record sheet P2 into the nip portion N exceeds the predetermined value E1 after the time t1, and also in such a case, there is a high possibility of doubly feeding the second record sheet P2 along with the first record sheet P1.

Therefore, the second control example is configured such that during a time period until the rear end of the record sheet P1 is drawn out from the nip portion N after the sheet sensor SN 1 has detected the front end of the record sheet P1 which has passed through the nip portion N, the output signal of the double feeding degree detecting sensor SN 2 is repeatedly checked at predetermined time intervals, and when it is determined that the output signal PE of the double feeding degree detecting sensor SN 2 exceeds the predetermined value E1, similar to the first control example, the separating force controller enhances the rotational torque Tr in the reverse direction of the separating roller 3 or reduce the press contact force F0 of the separating roller 3.

Specifically, the second control example is the same as the above-described first control example until the record sheet P at inside of the discharge tray 60 is drawn out, separation feeding of the record sheet P1 is started, (ST 1) and the front end of the record sheet P1 is detected by the sheet sensor SN 1 after entering into the nip portion N (ST 2). Thereafter, the controller 50 checks whether the rear end of the rear end of the first record sheet P1 has drawn out from the nip portion N, that is, whether operation of separating the first record sheet P1 and the second record sheet P2 is finished (ST 7), when it is determined that the separating operation has not been finished, the separating force controller 51 inputs the output signal PE of the double feeding degree detecting sensor SN 2 (ST 3) and checks whether the output signal PE exceeds the predetermined value E1 (ST 4). When it is determined that the output signal PE does not exceed the predetermined value E1, the separating force controller 51 returns to ST 7 to check whether the rear end of the first record sheet P1 has drawn out from the nip portion N.

Figure 9:
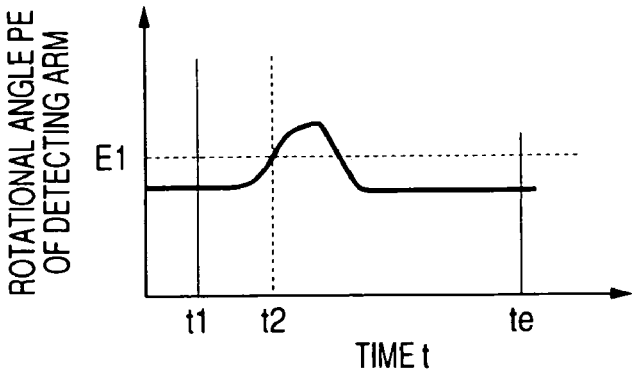
FIG. 9 is a graph showing an elapse of time of the output signal of the double feeding degree detecting sensor according to the second example.

By repeating ST 7, ST 3, ST 4, it can be confirmed whether the output signal PE of the double feeding degree detecting sensor SN 2 exceeds the predetermined value E1 in feeding the first record sheet P1. FIG. 9 shows an example of a change in the output signal PE of the double feeding degree detecting sensor SN 2 according to the second control example. Although at the time t1 at which the front end of the first record sheet is detected by the sheet sensor SN 1, the output signal PE of the double feeding degree detecting sensor SN 2 is equal to or smaller than the predetermined value E1, thereafter, the output signal PE exceeds the predetermined value E1 at a time point of reaching time t2.

When it is determined that the output signal PE of the double feeding degree detecting sensor SN 2 exceeds the predetermined value E1 in this way at ST 4, the separating force controller 51 controls the upper limit transmitting torque of the electromagnetic clutch 80 to enhance the rotational torque Tr in the reverse direction transmitted from the separating motor 8 to the separating roller 3. Or, the separating force controller 51 slightly rotates the nip pressure adjusting motor 6*e* to reduce the force F0 of bringing the separating roller 3 into press contact with the rear face of the second record sheet P2 (ST 5). Thereby, it can be effectively prevented that the second record sheet P2 is doubly fed to the first feeding path by being dragged by the first record sheet P1 similar to the first control example.

When the first record sheet is fed to the first sheet feeding path SH 1 while preventing double feeding in this way, the controller C determines whether the rear end of the first record sheet P1 has drawn out from the nip portion N and instructs to stop the feeding motor 7 and the separating motor 8 when it is determined that the rear end has drawn out therefrom. Thereby, separation feeding of the record sheet in the sheet feeding mechanism is finished (ST 6). Thereafter, the controller C checks whether the copy job has been finished and repeats to feed a successive one of the record sheet P when it is determined that the copy job has not been finished. Further, when at ST 7, the output signal PE of the double feeding degree detecting sensor SN 2 does not exceed the predetermined value E1 and the rear end of the first record sheet P1 has drawn out from the nip portion N, separation feeding of the record sheet is finished by similarly stopping the feeding motor 7 and the separating motor 8.

Although according to the above-described sheet feeding mechanism, as shown in FIG. 3, the separating motor 8 and the separating roller 3 are connected through the electromagnetic clutch 80 and the rotational torque in the reverse direction applied to the separating roller 3 is controlled by controlling the upper limit transmitting torque of the electromagnetic clutch 80, the electromagnetic clutch 80 may be omitted by using a DC motor as the separating motor 8 capable of controlling a rotational torque achieved by a magnitude of input current and directly and continuously connecting the DC motor and the separating roller 3.

Figure 10:
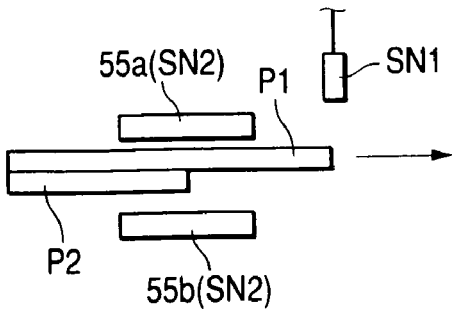
FIG. 10 is an enlarged view of a relevant portion showing a second embodiment of the double feeding degree detecting sensor.

Further, as the double feeding degree detecting sensor SN 2, other than the detecting sensor using the detecting arm 53 as shown in FIG. 4, for example, as shown in FIG. 10, there is conceivable a method of providing a pair of electrodes 55*a*, 55*b* interposing a path of feeding the record sheet P on a side before the sheet sensor SN 1 and detecting the entering distance of the second record sheet P2 into the nip portion N from a change in an electrostatic capacitance between the electrodes. That is, when the record sheet P2 is entered the nip portion by being overlapped on the record sheet P1 and the front end of the record sheet P2 is inserted between the electrodes 55*a*, 55*b*, the electrostatic capacitance between two sheets of the electrodes 55*a*, 55*b* is entered in accordance with a degree of advancing the record sheet P2 between the electrodes. Therefore, an entering distance of the second record sheet P2 into the nip portion N can be determined from a change in the electrostatic capacitance.

Figure 11:
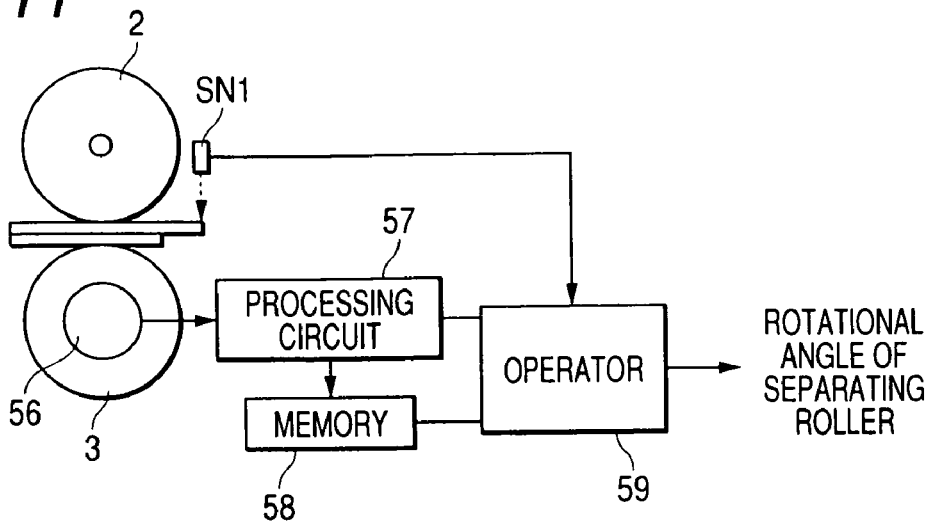
FIG. 11 is an enlarged view of a relevant portion showing a third embodiment of the double feeding degree detecting sensor.
Figure 12:
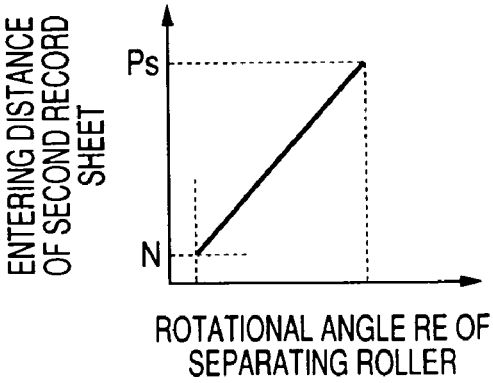
FIG. 12 is a graph showing an example of an output signal of the double feeding degree detecting sensor shown in FIG. 11.

Further, the double feeding degree detecting sensor SN 2 may be configured to detect a rotational angle of the separating roller 3 and grasp an entering distance of the second record sheet P2 into the nip portion from the rotational angle. Specifically, as shown in FIG. 11, an encoder 56 is attached to the rotating shaft of the separating roller 3 and an output signal of the encoder 56 is converted into angle information by a processing circuit 57. The angle information outputted from the processing circuit 57 is stored to a memory 58 at predetermined time intervals after starting to feed the record sheet P1 by the pickup roller 4. Meanwhile, when the sheet sensor SN 1 detects the front end of the first record sheet P1, an operator 59 reads information RE 2 of the rotational angle of the separating roller 3 at the timing from the processing circuit 57. Further, the operator 59 reads information RE 3 of the rotational angle of the separating roller 3 at the timing at which the front end of the first record sheet P1 is entered the nip portion N. Further, a difference RE between RE 2 and RE 3 corresponds to a rotational angle of the separating roller 3 during a time period until the first record sheet P1 arrives at a detecting region by the sheet sensor SN 1 from the nip portion N and the rotational angle RE corresponds to an entering distance of the second record sheet from the nip portion. Further, the timing at which the front end of the first record sheet of the P1 is entered nip portion N can be calculated by the timing at which the sheet sensor detects the first record sheet and the speed of feeding the first record sheet. Therefore, by calculating the rotational angle RE of the separating roller by the operator 59, an entering distance of the second record sheet P2 into the nip portion can be grasped.

However, in order to accurately correspond the rotational angle RE of the separating roller 3 to the entering distance of the second record sheet P2 into the nip portion N, it is necessary that the front end of the second record sheet P2 is disposed immediately before the nip portion N at the time point at which first record sheet P1 is entered the nip portion N. For such a situation, as described above, it is preferable to control to set the force of bringing the pickup roller 4 into press contact with the record sheet P at inside of the discharge tray 60 to be slightly large to thereby draw out a plurality of record sheets P on the discharge tray 60 to the nip portion N by rotating the pickup roller 4.

Figure 13:
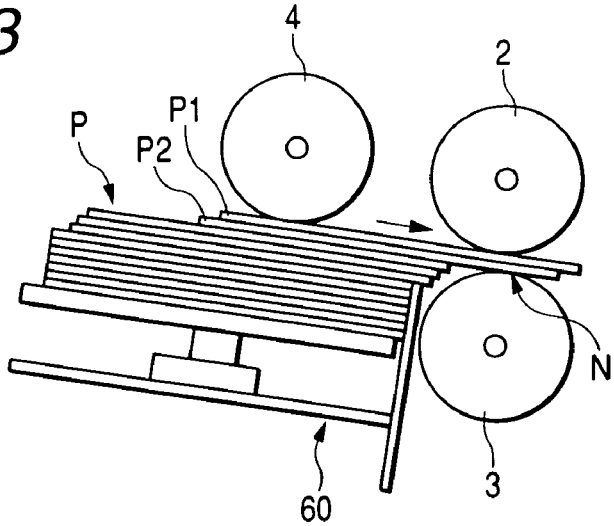
FIG. 13 is an outline view showing an example of installing a discharge tray being inclined to a feeding roller.

Further, in order to draw out also the second record sheet P2 to immediately before the nip portion N when the first record sheet P1 to be transported is drawn out from the discharge tray 60 by rotating the pickup roller 4, as shown in FIG. 13, the record sheet P at inside of the discharge tray 60 may be configured to move to the nip portion N by its own weight by inclining the discharge tray 60 to the feeding roller 2.

Further, when an entering distance of the second record sheet P2 into the nip portion N is grasped by the rotational angle RE of the separating roller 3, a state in which only one sheet of the record sheet P1 is present at the nip portion N cannot be differentiated from a completely double feeding state in which two sheets of the record sheets P1, P2 entered the nip portion N are advanced together without producing a speed difference therebetween and therefore, it is necessary to detect a number of record sheets P present at the nip portion N. As means for detecting a number of record sheets P, a sensor therefor may be provided at a vicinity of the nip portion N and as such a sensor, the configuration of the detecting arm 31 shown in FIG. 4 or the electrodes 55*a*, 55*b* as the electrostatic capacitance meter shown in FIG. 10 can be utilized.

Figure 14:
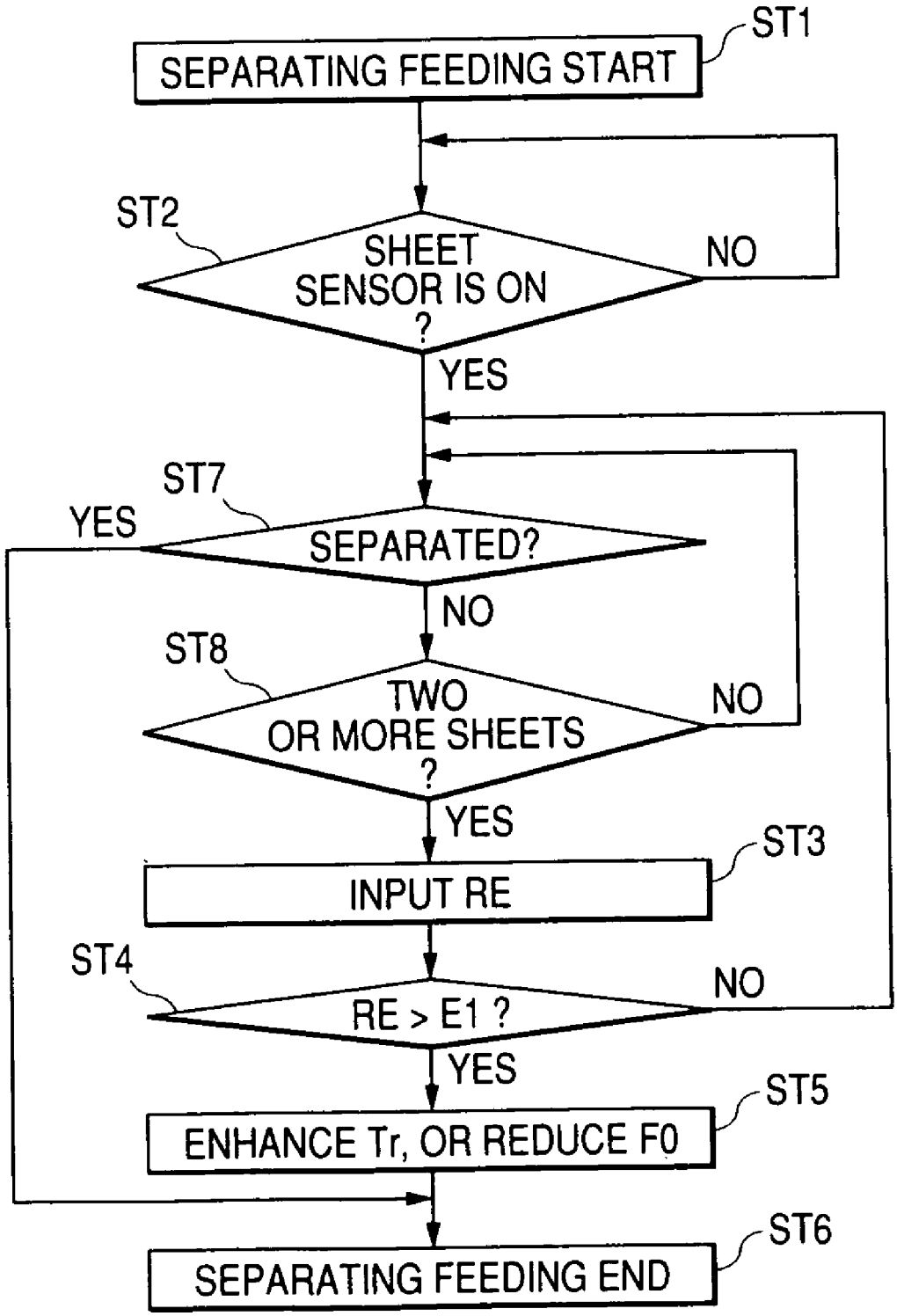
FIG. 14 is a flowchart showing a third control example of the feeding mechanism according to the first embodiment of the invention.

Further, when such a sheet number sensor is provided at a vicinity of the nip portion N, the above-described first and the second control examples may be carried out only when a plurality of record sheets P are present at the nip portion. FIG. 14 is a flowchart showing a third control example combining the second control example with a sheet number sensor. As the double feeding degree detecting sensor SN 2, as shown in FIG. 11, unit for detecting the rotational angle of the separating roller 3 is used. According to the flowchart of the third control example, all of the steps other than ST 8 are the same as those of the second control example of FIG. 8. That is, when it is determined that the rear end of the first record sheet P1 is not drawn out from the nip portion N, it is checked whether two or more sheets of the record sheets P are present in reference to the output signal of the sheet number sensor (ST 8), the detecting signal of the double feeding degree detecting sensor SN 2 is read at ST 3 only when two or more sheets of the record sheets P are present, and an entering distance of the second record sheet P2 into the nip portion N is confirmed. Further, when it is determined that only one sheet of the record sheet P1 is present at the nip portion N, the detection signal of the double feeding degree detecting sensor SN 2 is not read and the operation returns to ST 7 and it is checked whether the rear end of the record sheet P1 is drawn out from the nip portion N.

Thereby, when only one sheet of the record sheet is projected to the nip portion in the first place, operation of feeding the record sheets can be continued without determining whether the control parameter for separating the record sheets is pertinent and processing load of the separating controller 51 can be reduced.

Second Embodiment

A second embodiment of the invention will be explained as follows.

The second embodiment of the invention is configured such that a rotary encoder 3*a* is attached to the rotating shaft of the separating roller 3, and a speed operator 3*b* inputs an output signal of the rotary encoder 3*a* to detect the rotational speed of the separating roller 3. In the case in which in drawing out the record sheet P at inside of the discharge tray 60 by rotating the pickup roller 4 to transport to the nip portion N, the second record sheet P2 is also entered the nip portion by being dragged by the topmost record sheet (first record sheet) P1, when the second record sheet P2 is made to advance by being dragged by the first record sheet P1 at the nip portion N, the separating roller 3 is rotated in coincidence with advancement of the second record sheet P2. Therefore, when the rotational speed of the separating roller 3 is detected in this way, an advancing speed of the second record sheet P2 overlappingly fed with the first record sheet P1 at the nip portion N can be grasped. That is, a combination of the rotary encoder 3*a* and the speed operator 3*b* corresponds to a double feeding speed detecting sensor SN 3 according to the invention.

Further, a sheet number detecting sensor SN 4 for detecting whether a number of record sheets P entered the nip portion N is single or plural is provided between the nip portion N and a detecting position of the sheet sensor SN 1. The sheet number detecting sensor SN 4 is provided with, for example, an ultrasonic transmitter and an ultrasonic receiver interposing a path of feeding the record sheet and determining double feeding of the record sheets based on a difference in an output signal of the receiver (refer to JP-A-2000-95390), or a configuration determining double feeding of the record sheets from a change in an electrostatic capacitance between a pair of electrodes provided by interposing a path of feeding the record sheet (refer to JP-A-11-301855) can be used.

Figure 17:
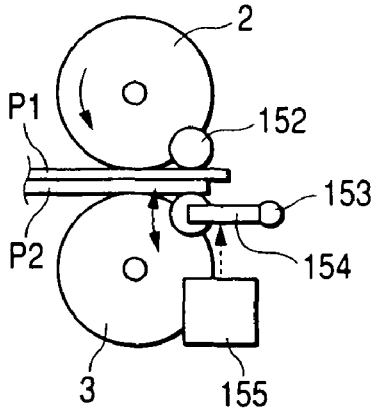
FIG. 17 is an enlarged view of a relevant portion showing a first embodiment of a sheet number detecting sensor.
Figure 18:
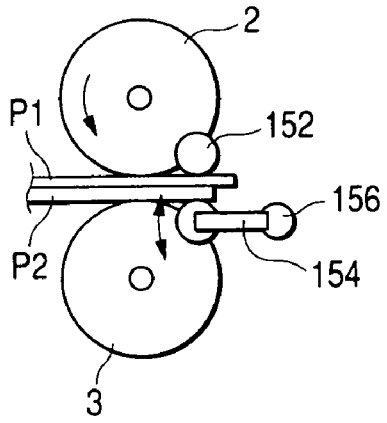
FIG. 18 is an enlarged view of a relevant portion showing a second embodiment of a sheet number detecting sensor.

The sheet number detecting sensor SN 4 may detect the thickness of the record sheet entered the nip portion by mechanical contact as shown in FIG. 17. Specifically, the sheet number detecting sensor SN 4 is configured by a base member 152 brought into contact with the surface of the first record sheet P1 on a down stream side of the feeding roller 2 in the direction of feeding the record sheet P, a detecting arm 154 a front end of which is urged to the base member 152 and which is pivotable centering on a supporting shaft 153, and a displacement meter 155 for measuring a displacement amount of the detecting arm 154, and grasps a number of record sheets P present at the nip portion N by pivoting the detecting arm 154 in accordance with a thickness, that is, a number of record sheets P entered the nip portion N and measuring the displacement amount of the detecting arm 154. Further, the sheet number detecting sensor S4 can also be configured such that the displacement amount of the detecting arm 154 is not measured by the displacement meter 155 but as shown in FIG. 18, a rotary encoder 156 is attached to the supporting shaft of the detecting arm 154 and a pivoting angle of the detecting arm 154, that is, the thickness of the record sheets P present at the nip portion is grasped from an output signal of the rotary encoder 156. Further, since the separating roller 3 is also moved in an up and down direction in accordance with the number of record sheets entered the nip portion, the sheet number detecting sensor SN 4 can also be configured such that the displacement amount of the pivoting arm 6 supporting the separating roller 3 is measured by the displacement meter to thereby grasp the number of record sheets P present at the nip portion P.

Output signals of the sheet sensor SN 1, the double feeding speed detecting sensor SN 3 and the sheet number detecting sensor SN 4 are inputted to the separating force controller 51. The separating force controller 51 is configured as a portion of the controller 50 and is provided with an input/output interface, not illustrated, for controlling to input and output signals to and from outside and levels of the input and output signals and so on, ROM (Read Only Memory) stored with programs, data and the like for executing necessary processing, RAM (Random Access Memory) for temporarily storing necessary data, CPU (Control Processing Unit) for executing processing in accordance with the programs stored to ROM, a clock oscillator and the like to realize various functions by executing the programs stored to ROM. Further, the separating force controller 51 is connected with the sheet feeding motor, the separating motor 8, the electromagnetic clutch 80 for coupling the separating motor 8 and the separating roller 3, and the nip pressure adjusting motor 6*e* and outputs control signals to the apparatus.

Next, an explanation will be given of a first control example of operation of feeding the record sheet in the sheet feeding mechanism.

Figure 19:
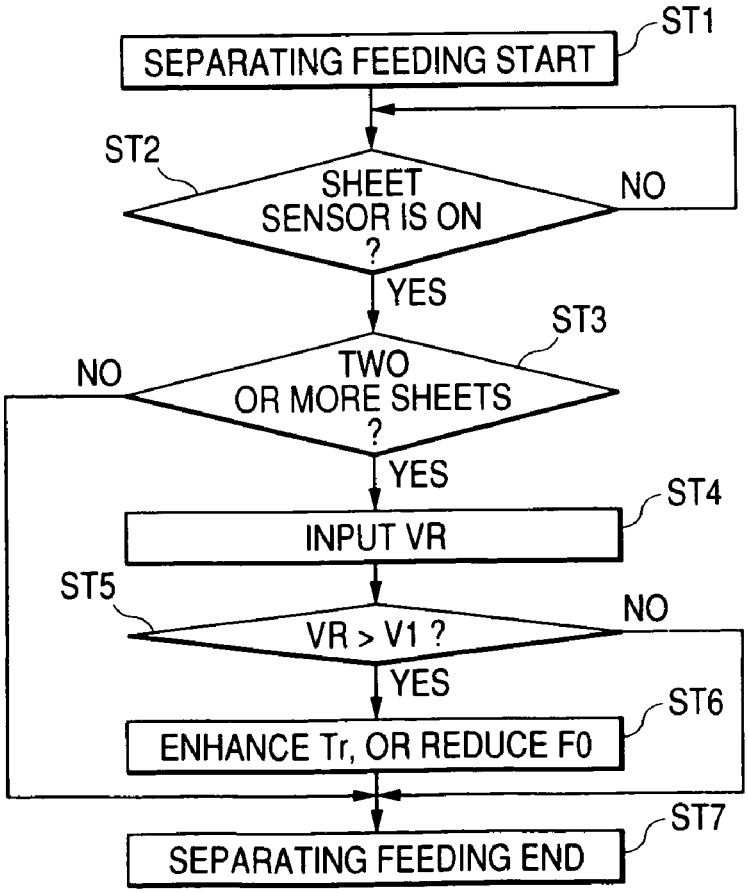
FIG. 19 is a flowchart showing a first control example of the sheet feeding mechanism according to the second embodiment of the invention.

FIG. 19 is a flowchart showing a processing procedure of the first example of the sheet feeding operation. First, the controller C checks whether a copy button provided at inside of an operation panel of the user interface 22 is pressed, that is, whether copy job is instructed to start by checking an output signal of the user interface 22. When it is determined that the copy job is instructed to start, the controller C checks whether a timing of feeding the record sheet P has arrived and when the sheet feeding timing is determined, the controller C instructs to start to drive the sheet feeding motor and the separating motor 8. Thereby, the sheet feeding motor 7 and the separating motor 8 start rotating.

When the sheet feeding motor starts driving, the feeding roller 2 and the pickup roller 4 start rotating, among the record sheets P set to the discharge tray 60 or 61, the topmost record sheet P1 is fed from the discharge tray 60 or 61 by the pickup roller 4 and is fed to the nip portion N at which the feeding roller 2 and the separating roller 3 are brought into press contact with each other. Operation up to the point corresponds to "separation feeding start" at ST 1 of FIG. 19.

Further, it is preferable to set the force of bringing the pickup roller 4 into press contact with the record sheet P1 to a degree of always drawing a plurality of record sheets P from the discharge tray 60 to the nip portion N by rotating the pickup roller 4. Because when the front end of the second record sheet P2 is drawn to immediately before the nip portion N in passing the first record sheet P1 through the nip portion N, a delay in feeding the second record sheet P2 can be reduced, further, the reduction is effective also for reducing a failure in feeding.

Figure 15:
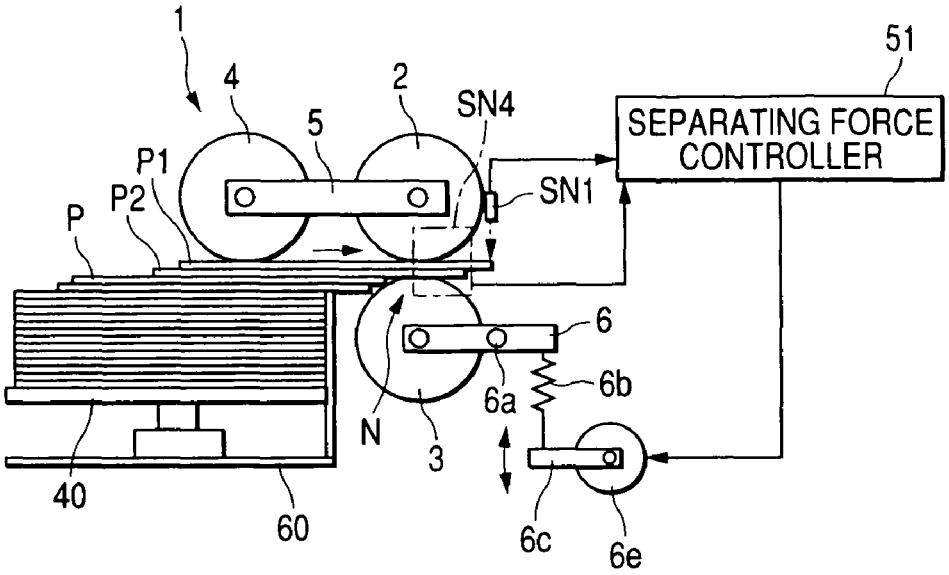
FIG. 15 is an outline block diagram of the sheet feeding mechanism to which a second embodiment of the invention is applied.

Next, the controller C checks the output signal of the sheet sensor SN 1 to thereby check whether the front end of the record sheet P1 fed from the discharge tray 60 or 61 is inserted into the nip portion N of the feeding roller 2 and the separating roller 3 (ST 2). Since the sheet sensor SN 1 is provided on the downstream side of the nip portion N in the direction of feeding the record sheet P1, such change in the output signal of the sheet sensor SN 1 signifies that the front end of the record sheet P1 is entered the nip portion N and passes through the sheet number detecting sensor SN 4 as shown in FIG. 15. When the controller C determines that the front end portion of the record sheet P1 passes the nip portion N from a change in the detecting signal of the sheet sensor SN 1, the controller C transmits a control signal to the electromagnetic clutch to separate the pickup roller 4 from the sheet feeding motor. Thereafter, the pickup roller 4 is driven to rotate by feeding the first record sheet P1. For convenience of the explanation, a timing at which the output signal of the sheet sensor SN 1 is changed is designated by notation t1.

Further, at time t1, the separating force controller 51 configuring a portion of the controller C checks whether two or more sheets of the record sheets P are present at the nip portion N in reference to an output signal of the sheet number detecting sensor SN 4 (ST 3), inputs an output signal VR of the double feeding speed detecting sensor SN 3 when it is determined that two or more of record sheets P are present at the nip portion N (ST 4), and checks whether the output signal VR exceeds a predetermined value V1 (ST 5). The separating force controller 51 refers to the output signal of the sheet number detecting sensor SN 4 before inputting the output signal of the double feeding speed detecting sensor SN 3 because when only the first record sheet P1 is assumedly present at the nip portion N, the output signal of the double feeding speed detecting sensor SN 3 indicates the speed of feeding the first record sheet P1. That is, because the rotational speed of the separating roller 3 indicates the advancing speed of the second record sheet P2 when two sheets of the record sheets P1, P2 are present at the nip portion N and the number of record sheets present at the nip portion N cannot be determined only from the output signal of the double feeding speed detecting sensor SN 3.

Figure 20:
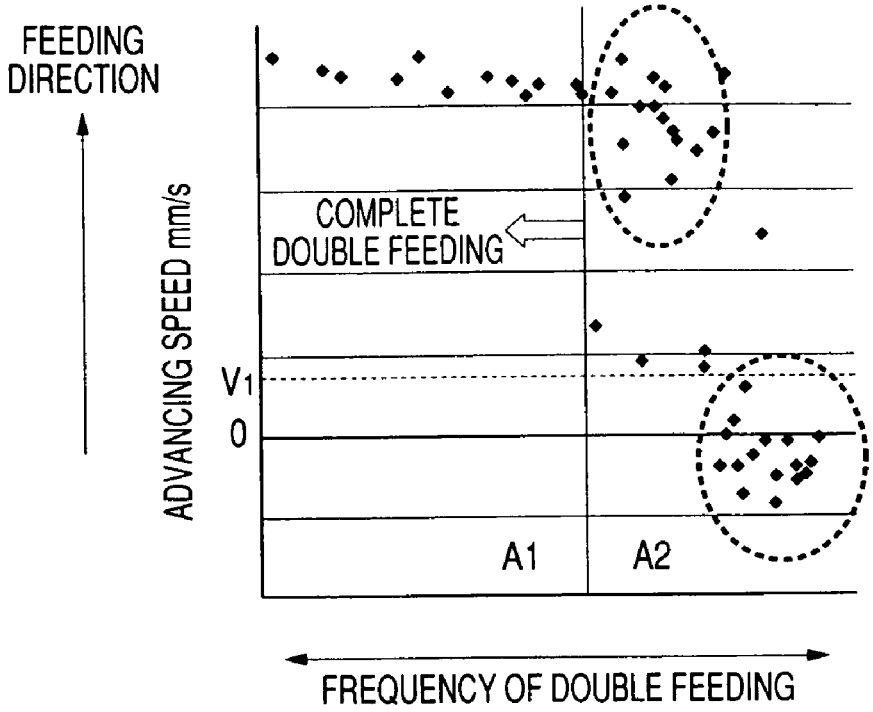
FIG. 20 is a graph showing a relationship between an advancing speed of a second record sheet at a nip portion and a frequency of bringing about double feeding.

FIG. 20 is a graph showing a correlation between the advancing speed of the second record sheet P2 brought into contact with the separating roller 3 and a frequency of occurrence of double feeding in which the second record sheet P2 is drawn out from the nip portion N along with the first record sheet P1 when two sheets of the record sheets P1, P2 are present at the nip portion N. The speed of transporting the second record sheet P2 in this case is measured at a timing at which the front end of the first record sheet P1 is detected by the sheet sensor SN 1. Respective points in the graph show a result of changing various parameters of a kind of the record sheet, the press contact force of the separating roller 3, the rotational torque in the reverse direction of the separating roller 3 and the like. Here, a region A1 on a left side of a bold line vertically drawn at the center of the graph is a region of bringing about complete double feeding in which the second record sheet P2 is fed without being shifted from the first record sheet P1, and the advancing speed of the second record sheet P2 at the nip portion N is the same as the speed of feeding the first record sheet P1 by the feeding roller 2. Further, a region A2 on a right side of the bold line is a region in which the first record sheet P1 and the second record sheet P2 are separated from each other and also in the region A2, the double feeding frequency tends to increase when the advancing speed of the second record sheet P2 becomes proximate to the speed of feeding the first record sheet P1. Meanwhile, when the advancing speed of the second record sheet P2 detected by the double feeding speed detecting sensor SN 3 is sufficiently small, or the second record sheet P2 is operated in a direction reverse to that of the first record sheet P1 by rotating the separating roller 3 in the reverse direction, the double feeding frequency is significantly reduced. Therefore, when the speed of feeding the second record sheet P2 is smaller than a constant speed (for example, V1), it can be determined that double feeding is not brought about.

When the output signal VR of the double feeding speed detecting sensor SN 3 is checked and it is determined that the output signal VR does not exceed the predetermined value V1 at ST 5 therefrom, the advancing speed of the second record sheet P2 at the nip portion N is small and there is not a possibility that the second record sheet P2 is doubly fed as it is along with the first record sheet P1 and therefore, the record sheet P1 is continued to feed by rotating the feeding roller 2 as it is.

Figure 21:
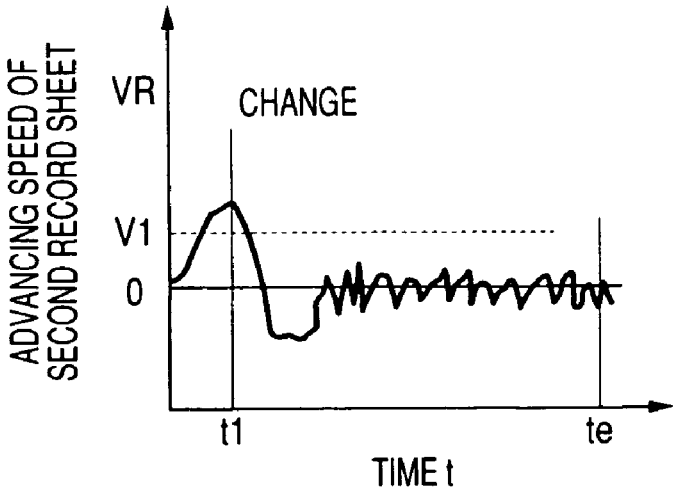
FIG. 21 is a graph showing an elapse of time of the output signal of the double feeding speed detecting sensor according to the first control example.

Meanwhile, in the case in which it is determined that the output signal VR of the double feeding speed detecting sensor SN 3 exceeds the predetermined value V1 at the time t1 as shown in FIG. 21, when the first record sheet P1 is continued to feed as it is, as described above, there is a high possibility of bringing about double feeding by feeding also the second record sheet P2 to the first sheet feeding path SH 1 along therewith. Therefore, the separating force controller 51 controls an upper limit transmitting torque of the electromagnetic clutch 80 to enhance a rotational torque Tr in a reverse direction transmitted from the separating motor 8 to the separating roller 3. Or, the separating force controller 51 reduces a force F0 of bringing the separating roller 3 into press contact with the rear face of the second record sheet P2 by slightly rotating the nip pressure adjusting motor 6*e* (ST 6). When the rotational torque Tr in the reverse direction transmitted from the separating motor 8 to the separating roller 3 is enhanced, a force of pushing back the second record sheet P2 in the direction of the discharge tray 60 is enhanced and a separating force operated between the first record sheet P1 and the second record sheet P2 can be enhanced by that amount. Further, when the press contact force F0 of the separating roller 3 is reduced, a friction force operated between the first record sheet P1 and the second record sheet P2 is reduced and therefore, the separating force operated between the first record sheet P1 and the second record sheet P2 can similarly be enhanced.

At ST 5 of FIG. 19, the separating force controller may enhance the rotational torque Tr in the reverse direction of the separating roller 3 or may reduce the press contact force F0 of the separating roller 3, or may enhance the rotational torque Tr and reduce the press contact force F0.

Thereby, it can effectively be prevented that the second record sheet P2 is doubly fed to the first sheet feeding path by being dragged by the first record sheet P1. Above all, a control parameter for separating the first record sheet and the second record sheet can instantly be changed by determining the possibility of bringing about double feeding of the record sheets with regard to sheet feeding operation which is being carried out and therefore, occurrence of double feeding can firmly be prevented. Further, by detecting the advancing speed of the second record sheet P2 at the nip portion N, the possibility of bringing about double feeding is determined simultaneously with carrying out the sheet feeding operation and therefore, the control parameter of separating force is not unreasonably changed although the possibility of bringing about double feeding is low and a load on the feeding roller 2 can be reduced by that amount and sheet feeding operation can be stabilized.

When the first record sheet is fed to the first sheet feeding path SH 1 while preventing double feeding in this way, the controller C determines whether the rear end of the first record sheet P1 is drawn out from the nip portion N and instructs to stop the feeding motor 7 and the separating motor 8 when the rear end is determined to draw out therefrom. Thereby, separation feeding of the record sheet in the sheet feeding mechanism is finished (ST 7). Thereafter, the controller C checks whether the copy job has been finished and repeats to feed a successive one of the record sheet P when it is determined that the copy job has not been finished.

Figure 22:
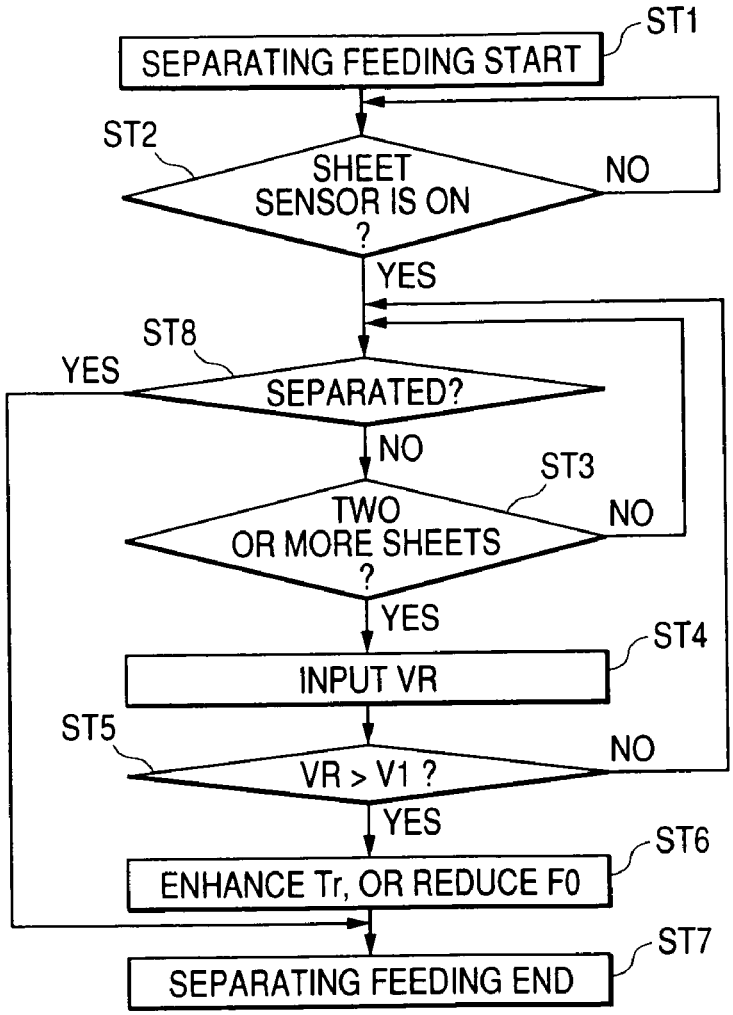
FIG. 22 is a flowchart showing a second control example of a sheet feeding mechanism according to the second embodiment of the invention.

FIG. 22 is a flowchart showing a processing procedure of a second control example of sheet feeding operation.

According to the above-described first control example, the output signal of the double feeding speed detecting sensor SN 3 is checked only at the timing at which the front end of the first record sheet P1 entered the nip portion N is detected by the sheet sensor SN 1, that is, only at time t1, and when the speed advancing VR of advancing the second record sheet P2 at the nip portion is equal to or smaller than the predetermined value V1 at the timing, the rotational torque Tr in the reverse direction of the separating roller 3 is not changed and the press contact force F0 of the separating roller 3 is not also changed. However, there is also a case in which the speed VR of advancing the second record sheet P2 at the nip portion N exceeds the predetermined value V1 after the time t1, and also in such a case, there is a high possibility of doubly feeding the second record sheet P2 along with the first record sheet. P1.

Therefore, the second control example is configured such that during a time period until the rear end of the record sheet P1 is drawn out from the nip portion N after the sheet sensor SN 1 has detected the front end of the record sheet P1 which has passed through the nip portion N, the output signal of the double feeding speed detecting sensor SN 3 is repeatedly checked at predetermined time intervals, and when it is determined that the output signal VR of the double feeding speed detecting sensor SN 3 exceeds the predetermined value V1, similar to the first control example, the separating force controller 51 enhances the rotational torque Tr in the reverse direction of the separating roller 3 or reduce the press contact force F0 of the separating roller 3.

Specifically, the second control example is the same as the above-described first control example until the record sheet P at inside of the discharge tray 60 is drawn out, separation feeding of the record sheet P1 is started, (ST 1) and the front end of the record sheet P1 is detected by the sheet sensor SN 1 after entering into the nip portion N (ST 2). Thereafter, the controller 50 checks whether the rear end of the first record sheet of P1 is drawn out from the nip portion N, that is, operation of separating the first record sheet P1 and the second record sheet P2 has been finished (ST 8), and checks whether two or more of record sheets are present at the nip portion N in reference to the output signal of the sheet number detecting sensor SN 4 when it is determined that the operation has not finished (ST 3). Whereas when the controller 50 determines that only one sheet of the record sheet P1 is present at the nip portion, the controller 50 returns to ST 8 to check whether the rear end of the first record sheet P1 is drawn out from the nip portion N, when the controller 50 determines that two or more of record sheets are present at the nip portion, the separating force controller 51 inputs the output signal VR of the double feeding speed detecting sensor SN 3 (ST 4) and checks whether the output signal VR exceeds the predetermined value V1 (ST 5). When it is determined that the output signal VR does not exceed the predetermined value V1, the operation returns to ST 8 to check whether the rear end of the first record sheet P1 is drawn out from the nip portion N.

Figure 23:
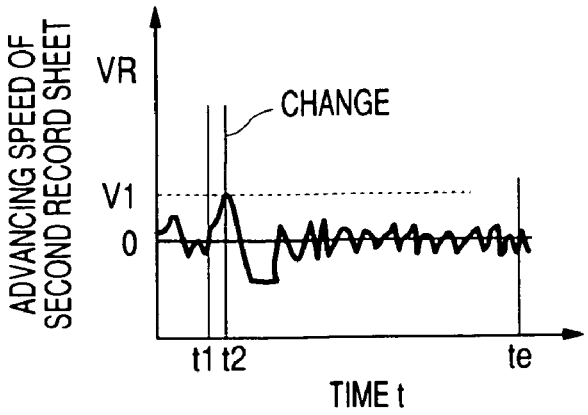
FIG. 23 is a graph showing an elapse of time of an output signal of a double feeding speed detecting sensor according to the second control example.

By repeating ST 8, ST 3, ST 4 and ST 5 it can be confirmed whether the output signal VR of the double feeding speed detecting sensor SN 3 exceeds the predetermined value V1 in feeding the first record sheet P1. FIG. 23 shows an example of a change in the output signal VR of the double feeding speed detecting sensor SN 3 according to the second control example. Although at the time t1 at which the front end of the first record sheet is detected by the sheet sensor SN 1, the output signal VR of the double feeding speed detecting sensor SN 3 is equal to or smaller than the predetermined value V1, thereafter, the output signal VR exceeds the predetermined value V1 at a time point of reaching time t2.

When it is determined that the output signal VR of the double feeding speed detecting sensor SN 3 exceeds the predetermined value V1 in this way at ST 5, the separating force controller 51 controls the upper limit transmitting torque of the electromagnetic clutch 80 to enhance the rotational torque Tr in the reverse direction transmitted from the separating motor 8 to the separating roller 3. Or, the separating force controller 51 slightly rotates the nip pressure adjusting motor 6*e* to reduce the force F0 of bringing the separating roller 3 into press contact with the rear face of the second record sheet P2 (ST 6). Thereby, it can be effectively prevented that the second record sheet P2 is doubly fed to the first feeding path by being dragged by the first record sheet P1 similar to the first control example.

When the first record sheet is fed to the first sheet feeding path SH 1 while preventing double feeding in this way, the controller C determines whether the rear end of the first record sheet P1 has drawn out from the nip portion N and instructs to stop the feeding motor 7 and the separating motor 8 when it is determined that the rear end has drawn out therefrom. Thereby, separation feeding of the record sheet in the sheet feeding mechanism is finished (ST 7). Thereafter, the controller C checks whether the copy job has been finished and repeats to feed a successive one of the record sheet P when it is determined that the copy job has not been finished. Further, when at ST 8, the output signal VR of the double feeding speed detecting sensor SN 3 does not exceed the predetermined value V1 and the rear end of the first record sheet P1 has drawn out from the nip portion N, separation feeding of the record sheet is finished by similarly stopping the feeding motor 7 and the separating motor 8.

Figure 16:
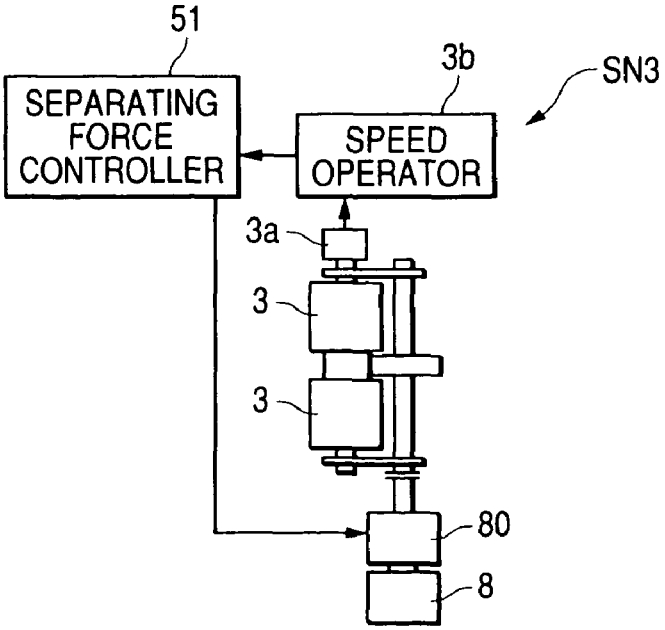
FIG. 16 is a plan view showing a system of driving a separating roller according to the second embodiment of the invention.

Although according to the above-described sheet feeding mechanism, as shown in FIG. 16, the separating motor 8 and the separating roller 3 are connected through the electromagnetic clutch 80 and the rotational torque in the reverse direction applied to the separating roller 3 is controlled by controlling the upper limit transmitting torque of the electromagnetic clutch 80, the electromagnetic clutch 80 may be omitted by using a DC motor as the separating motor 8 capable of controlling a rotational torque achieved by a magnitude of input current and directly and continuously connecting the DC motor and the separating roller 3.

Figure 24:
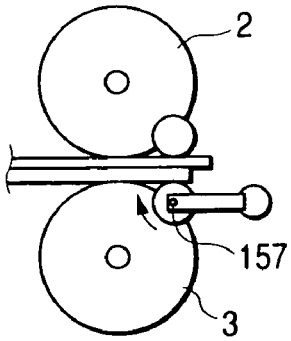
FIG. 24 is an enlarged view of a relevant portion showing a second embodiment of double feeding speed detecting sensor.

Further, the double feeding speed detecting sensor SN 3 may be configured such that as shown in, for example, FIG. 24, a speed detecting roller 157 is brought into contact with the rear face of the record sheet P2 entered the nip portion N, the rotational angle of the speed detecting roller 157 is detected by a rotary encoder to convert into the speed data other than the double feeding speed detecting sensor SN 3 for grasping the advancing speed of the second record sheet P2 from the rotational speed of the separating roller 3. Further, a noncontact type encoder used in an optical type mouse may be used.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet feeding apparatus comprising:

a feeding tray on which a plurality of record sheets are set;

a first feeding member that feeds at least an uppermost record sheet from the feeding tray;

a second feeding member that feeds the uppermost record sheet fed by the first feeding member;

a separating member, wherein a nip portion is formed between the separating member and the second feeding member, and when the uppermost record sheet and at least one of the next record sheets overlapping each other enter the nip portion, the separating member separates the entered at least one of the next record sheets from the entered uppermost record sheet;

an adjusting unit that changes a force of the separating member acting on the entered at least one of the next record sheets;

a detecting unit that detects an advancing speed of the other of the entered record sheets at the nip portion; and a controller that controls the adjusting unit to enhance the force in a case where the advancing speed of the detecting unit exceeds a predetermined value, wherein the separating member has a separating roller rotating in a direction of pushing back the entered at least one of the next record sheets toward the feeding tray, and the adjusting unit changes a rotational torque applied to the separating roller.

2. The sheet feeding apparatus according to claim 1, wherein the adjusting unit changes a force for bringing the separating member into press contact with the second feeding member.

3. The sheet feeding apparatus according to claim 1, wherein the controller checks a detection value of the detecting unit at a predetermined timing after a front end of the uppermost record sheet enters the nip portion, and the controller directs the adjusting unit to enhance the force in a case where the detection value exceeds a predetermined value.

4. The sheet feeding apparatus according to claim 1, wherein the detecting unit detects the advancing speed of the entered at least one of the next record sheets based on a rotational speed of the separating roller.

5. The sheet feeding apparatus according to claim 1, further comprising:

a detecting sensor that detects a number of the record sheets, which enter the nip portion, wherein the controller reads a detection value of the detecting unit in a case where the detecting sensor detects the number of record sheets, which enter the nip portion, is equal to or larger than 2.

6. The sheet feeding apparatus according to claim 5, wherein the detecting sensor includes a pair of electrodes interposing a path of feeding the record sheets, and measures a change in an electrostatic capacitance between the electrodes to determine an entering distance of the next record sheets into the nip portion.

7. The sheet feeding apparatus according to claim 1, wherein the separating member presses and stops the entered at least one of the next record sheets to separate the entered at least one of the record sheets from the entered uppermost record sheets.

8. The sheet feeding apparatus according to claim 1, wherein the first feeding member is distinct from the second feeding member.

9. The sheet feeding apparatus according to claim 1, wherein the second feeding member rotates to feed at least the plurality of the record sheets.

* * * * *